US008320601B2

(12) United States Patent
Takigawa et al.

(10) Patent No.: US 8,320,601 B2
(45) Date of Patent: Nov. 27, 2012

(54) EARPHONE DEVICE AND SOUND GENERATING APPARATUS EQUIPPED WITH THE SAME

(75) Inventors: Souichi Takigawa, Hamamatsu (JP); Yoshikatsu Matsubara, Hamamatsu (JP); Masahiro Sugiura, Hamamatsu (JP); Yasuaki Takano, Kikugawa (JP)

(73) Assignee: Yamaha Corporation, Hamamatsu-Shi (JP)

( * ) Notice: Subject to any disclaimer, the term of this patent is extended or adjusted under 35 U.S.C. 154(b) by 646 days.

(21) Appl. No.: 12/437,399

(22) Filed: May 7, 2009

(65) Prior Publication Data

US 2009/0285437 A1 Nov. 19, 2009

(30) Foreign Application Priority Data

May 19, 2008 (JP) ..... 2008-130560
Sep. 11, 2008 (JP) ..... 2008-233302

(51) Int. Cl.
*H04R 25/00* (2006.01)

(52) U.S. Cl. ..... 381/380; 381/322; 381/324; 381/72; 381/74

(58) Field of Classification Search ..... 381/322, 381/324, 328–330, 72, 74, 80–81, 85, 334, 381/101, 123, 380
See application file for complete search history.

(56) References Cited

U.S. PATENT DOCUMENTS

| | | | | |
|---|---|---|---|---|
| 5,729,605 | A * | 3/1998 | Bobisuthi et al. | 379/430 |
| 5,949,896 | A * | 9/1999 | Nageno et al. | 381/328 |
| 6,549,635 | B1 * | 4/2003 | Gebert | 381/324 |
| 7,065,219 | B1 * | 6/2006 | Abe et al. | 381/74 |
| 2007/0177753 | A1 * | 8/2007 | Weinans et al. | 381/373 |
| 2008/0281238 | A1 * | 11/2008 | Oohashi et al. | 601/46 |
| 2008/0298618 | A1 * | 12/2008 | Baumann et al. | 381/325 |
| 2008/0300703 | A1 * | 12/2008 | Widmer et al. | 700/97 |
| 2009/0028348 | A1 * | 1/2009 | Sokolich et al. | 381/59 |
| 2010/0061580 | A1 * | 3/2010 | Tiscareno et al. | 381/380 |

FOREIGN PATENT DOCUMENTS

| | | | |
|---|---|---|---|
| EP | 1 463 375 | A2 | 9/2004 |
| JP | 3-117995 | | 12/1991 |
| WO | WO-94/10818 | A1 | 5/1994 |
| WO | WO-2007/054589 | A2 | 5/2007 |
| WO | WO-2007/085307 | A1 | 8/2007 |

* cited by examiner

*Primary Examiner* — A. Sefer
(74) *Attorney, Agent, or Firm* — Dickstein Shapiro LLP

(57) ABSTRACT

An external inserting meatus of user is closed with an insert earphone device in use so that it is hard that external sound penetrates into the external inserting meatus; not only an internal sound propagation path but also an external sound propagation path are formed in an inserting body of the earphone device, and an active diaphragm is provided in the inserting body so as to make the external sound propagation path closed therewith and block the external auditory meatus from the external sound; the active diaphragm is formed from electroactive polymer layer sandwiched between electrodes, and the active diaphragm is deformed in the presence of voltage so as permit the user easily to control it.

20 Claims, 17 Drawing Sheets

EARPHONE DEVICE AND SOUND GENERATING APPARATUS EQUIPPED WITH THE SAME

FIELD OF THE INVENTION

This invention relates to an earphone and, more particularly, to an earphone device permitting user to hear environmental sound or human voice without removal from the user and a sound generating apparatus equipped with the earphone device.

DESCRIPTION OF THE RELATED ART

The various models of earphone devices are known to users. One of the models of earphone devices is called as insert earphone devices. When users hear sound converted from audio signals, they insert the insert earphone devices into their external auditory meatuses. The insert earphone device includes an inserting body, an audio signal-to-sound converter and a cable. The inserting body is formed with small holes, and the small holes are open to inner chambers of the inserting body and the outside of inserting body. The audio signal-to-sound converter is provided in the inner chamber, and the cable is connected between the audio signal-to-sound converter and a sources of audio signal such as, for example, a hearing aid, a telephone receiver or a sound reproduction apparatus.

When the user wishes to hear music, news and etc. through the insert earphone device, he or she inserts the inserting bodies into his or her external auditory meatus. Then, the inserting body is snugly received in the external auditory meatus, and the small holes are directed to the ear drum through the external auditory meatus. The user turns on the source of audio signal. Then, the audio signal is supplied from the source to the audio signal-to-sound converter, and is converted to sound by means of the audio signal-to-sound converter. The sound passes through the small holes, and enters the external auditory meatus. The sound is propagated through the air in the external auditory meatus, and gives rise to the vibrations of ear drum. Another model of earphones is provided to the users in the form of headphones.

While the user is taking on the earphone devices, it is hard to hear the environmental sound, because the inserting body is snugly received in the external auditory meatus of the user. Even if another person tries to talk to the user, the user does not immediately notice the person trying to talk to him or her. It is inconvenient to him or her.

A countermeasure is proposed in Japan Utility Model Application laid-open No. Hei 3-117995. The prior art insert earphone device is of the type inserted into the external auditory meatus. The inserting body of the prior art insert earphone device is formed with not only the small holes to be directed to the ear drum but also an additional small hole, and the additional small hole is formed at the back of the audio signal-to-sound converter. When a user inserts the inserting body into the external auditory meatus, the small holes are directed to the ear drums as similar to the standard prior art insert earphone device, and the additional small hole is directed to the environment. A slide plate is provided inside the inserting body, and is moved on the inner surface of the inserting body where the additional small hole is opened to the inner chamber. For this reason, the additional small hole is closable with the slide plate, and permits the inner chamber to be open to the outside of the inserting body. A small lug projects from the slide plate into the outside of inserting body so that the user can pinch the small lug with his or her thumb and finger for moving the slide plate.

While the user is hearing the sound by means of the prior art insert earphone device, he or she closes the additional small hole with the slide plate, and the environmental sound hardly penetrates into the external auditory meatus. When the user wishes to hear the environmental sound, he or she pinches the small lug with his or her thumb and finger, and makes the slide plate slide on the inner surface of inserting body in the direction to open the additional small hole. Then, the environmental sound enters the external auditory meatus through the additional small hole, inner chamber and small holes. Thus, the user can hear the environmental sound without taking off the prior art earphone device.

However, a problem is encountered in the prior art earphone device in that the prior art insert earphone device is liable to be dropped off. In detail, the prior art earphone device takes the stable attitude in the external auditory meatus merely by virtue of the friction against the external ear. While the user is moving the slide plate with his or her thumb and finger, the user tends unintentionally to push and pull the small lug, and makes the prior art insert earphone device inclined in the external auditory meatus. As a result, the friction against the external ear is partially cancelled, and the reduced friction can not keep the prior art insert earphone device stable in the external auditory meatus. This results in the drop-off of the prior art insert earphone device from the external auditory meatus.

SUMMARY OF THE INVENTION

It is therefore an important object of the present invention to provide an earphone device, which permits users to hear environmental sound without unintentional drop-off from the external ear.

It is also an important object of the present invention to provide a sound generating apparatus, which is equipped with the earphone device.

The present inventors contemplated the problem inherent in the prior art earphone device, and noticed that the lug was rigidly connected to the slide plate, which in turn was mechanically coupled to the inserting body. The present inventors got it into their head to use an electric coupling between a change-over means for an external sound propagation path and a controller for the change-over means.

The rigid connection is not required for a signal between the controller and the change-over means. A flexible cable or a radio channel is available for the electric coupling so that a manipulation on the controller does not give rise to any movement of inserting body where the change-over means is retained.

To accomplish the object, the present invention proposes to use an electric coupling with an actuator.

In accordance with one aspect of the present invention, there is provided an earphone device connected to a source of sound signal for radiating sound into at least one external auditory meatus of a human being, and the earphone device comprises a signal-to-sound converter converting the sound signal to internal sound, a retainer connected to the signal-to-sound converter, engaged with at least one external ear of the human being and forming an internal sound propagation path for propagating the internal sound from the signal-to-sound converter to the aforesaid at least one external auditory meatus and an external sound propagation path open at one end thereof to an environment and at the other end to the aforesaid at least one external auditory meatus for propagating external sound and an actuator connected to the retainer, and responsive to voltage so as to be deformed for closing the external sound propagation path therewith and permitting the environment to be conducted to the external auditory meatus through the external sound propagation path.

In accordance with another aspect of the present invention, there is provided a sound generating apparatus for generating internal sound to a human being comprising a source of sound signal for producing a sound signal, a source of voltage for generating voltage, an earphone device including a signal-to-sound converter connected to the source of sound signal and converting the sound signal to the internal sound, a retainer connected to the signal-to-sound converter, engaged with at least one external ear of the human being and forming an internal sound propagation path for propagating the internal sound from the signal-to-sound converter to at least one external auditory meatus of the human being and an external sound propagation path open at one end thereof to an environment and at the other end thereof to the aforesaid at least one external auditory meatus for propagating external sound and an actuator connected to the retainer and responsive to the voltage so as to be deformed for closing the external sound propagation path therewith and permitting the environment to be conducted to the external auditory meatus through the external sound propagation path, and an electric coupler provided between the source of voltage and the actuator so as to supply the voltage to the actuator.

In accordance with yet another aspect of the present invention, there is provided an inserting body of an earphone device comprising a retainer connectable to a signal-to-sound converter, engaged with at least one external ear of the human being and forming an internal sound propagation path for propagating internal sound from the signal-to-sound converter to at least one external auditory meatus of a human being and an external sound propagation path open at one end thereof to an environment and at the other end thereof to the aforesaid at least one external auditory meatus for propagating external sound, and an actuator connected to the retainer and responsive to voltage applied thereto so as to be deformed for closing the external sound propagation path therewith and permitting the environment to be conducted to the external auditory meatus through the external sound propagation path.

BRIEF DESCRIPTION OF THE DRAWINGS

The features and advantages of the earphone device, sound generating apparatus and inserting body will be more clearly understood from the following description taken in conjunction with the accompanying drawings, in which.

DESCRIPTION OF THE PREFERRED EMBODIMENTS

Figure 1:
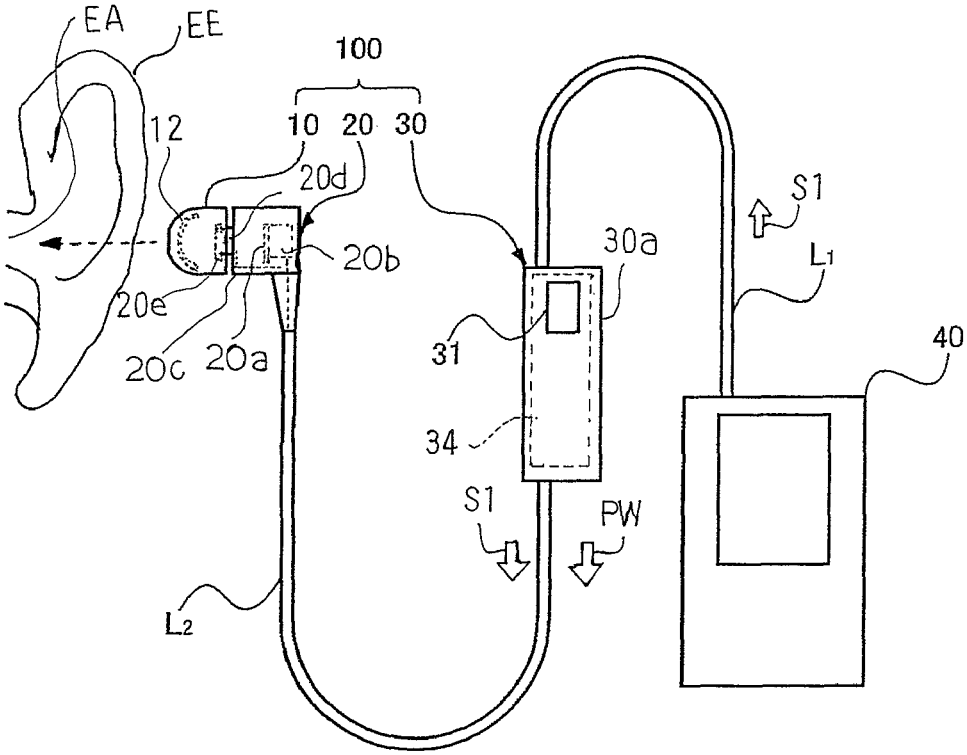
FIG. 1 is a front view showing the external appearance of an insert earphone device according to the present invention.

A sound generating apparatus of the present invention largely is used for generating internal sound to a human being, and largely comprises a source of sound signal, a source of voltage, an earphone device and an electric coupler. The earphone device is prepared for the sound generating apparatus in accordance with the present invention.

The source of sound signal produces a sound signal expressing the internal sound, and the source of voltage generates voltage. The earphone device is electrically coupled with the source of voltage through the electric coupler.

The earphone device includes a signal-to-sound converter, a retainer and an actuator. In detail, the signal-to-sound converter is connected to the source of sound for receiving the sound signal, and converts the sound signal to the internal sound. The retainer is connected to the signal-to-sound converter so that the internal sound is lead to the retainer. The retainer is engaged with at least one external ear of the human being, and keeps the signal-to-sound converter close to the external ear of human being.

An internal sound propagation path is formed in the retainer, and the internal sound is propagated from the signal-to-sound converter to at least one external auditory meatus of the human being through the internal sound propagation path.

The retainer further forms an external sound propagation path. The external sound propagation path is provided inside or outside the retainer. The external sound propagation path is open at one end thereof to an environment and at the other end thereof to the at least one external auditory meatus so that external sound, which is generated in the environment of human being, enters the external sound propagation path. The external sound propagation path is closed with the actuator, and the actuator permits the external sound propagation path to be open to the external auditory meatus.

The actuator is connected to the retainer, and per se is deformed in the presence of voltage. In other words, the actuator is responsive to the voltage supplied from the source of voltage so as to be deformed for closing the external sound propagation path and permitting the environment to be conducted to the external auditory meatus. The voltage is applied to the actuator through the electric coupler. In detail, the electric coupler is provided between the source of voltage and the actuator so as to supply the voltage to the actuator. The applied voltage gives rise to the deformation of actuator so as to cause the external sound propagation path to be closed with and opened by the actuator.

The electric coupler is not rigid. For example, an flexible cable can establish the electric coupling between the source of voltage and the actuator. Even if the human being manipulates the source of voltage with his or her fingers, movements of the source of voltage due to the force, which is exerted on the source of voltage, are absorbed by the flexible cable. As a result, the earphone device is not unintentionally dropped off from the external ear of human being.

First Embodiment

Referring to FIG. 1 of the drawings, an insert earphone device 100 of the present invention is connected to a portable sound signal generator 40 such as, for example, a music reproducer, a voice recorder/reproducer, a hearing aid or a portable radio through a cable L1. The cable L1 is connected at both ends thereof to the insert earphone device 100 and portable sound signal generator 40 through plugs and sockets. The portable sound signal generator 40 produces an audio signal S1, which represents music sound or human voice, and the audio signal S1 is propagated through the cable L1 to the insert earphone device 100. The music reproducer, voice recorder/reproducer, hearing aid, portable radio and etc. are well known to persons skilled in the art, and, for this reason, no further description is incorporated for the sake of simplicity.

The insert earphone device 100 largely comprises an inserting body 10, an active diaphragm 12, an electroacoustic device 20, a battery unit 30 and a cable L2. The active diaphragm 12 is provided inside the inserting body 10, and is electrically connected to a controller of electric power, i.e., the battery unit 30. In this instance, the cable L2 is used for the electric coupling between the battery unit 30 and the active diaphragm 12. The active diaphragm 12 permits environmental sound, which is generated outside of the inserting body 10, to penetrate into an external auditory meatus EA of a user, and blocks the external auditory meatus EA from the outside under the control of the battery unit 30. The inserting body 10 is detachably connected to the electroacoustic device 20 so that the inserting body 10 is separable from the electroacoustic device 20. Otherwise, the inserting body 10 and electroacoustic device may have a unitary structure as shown. A user inserts the inserting body 10 into his or her external auditory meatus EA, and the inserting body 10 keeps the electroacoustic device 20 on the external ear EE of the user. The battery unit 30 is connected to the electroacoustic device 20 and active diaphragm 12 through the cable L2. The electroacoustic device 20 converts the audio signal S1 to sound, and the sound is radiated from the electroacoustic device 20 through the inserting body 10 into the external auditory meatus EA. The sound, which is radiated from the electroacoustic device 20, is hereinafter referred to as "internal sound".

The battery unit 30 has an inner electric path (not shown), and the audio signal S1 is propagated through the inner electric path of battery unit 30 to the cable L2. The audio signal S1 is supplied through the cable L2 to the electroacoustic device 20. The battery unit 30 internally generates electric power, and the electric power PW is supplied from the battery unit 30 through the cable L2 to the active diaphragm 12 in the inserting body 10 so as to permit the environmental sound or sound around the user to be propagated through the inserting body 10 to an external auditory meatus EA of user as will be described hereinafter in detail. The sound around the user is hereinafter referred to as "external sound".

Figure 2A:
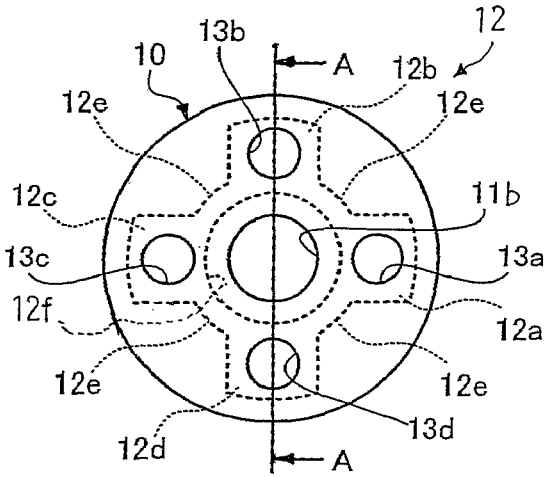
FIG. 2A is a left side view showing an active diaphragm provided in an inserting body of the insert earphone device.
Figure 2B:
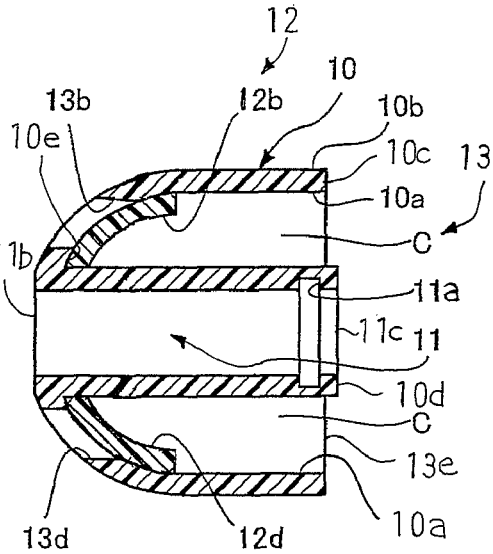
FIG. 2B is a cross sectional view taken along line A-A of FIG. 2A and showing the active diaphragm.

Turning to FIGS. 2A and 2B, the inserting body 10 has a configuration like a frustum of cone plus a circular cylinder so that user can easily insert the inserting body 10 into his or her external auditory meatus EA. In this instance, the inserting body 10 is made of synthetic resin such as, for example, silicone resin. The friction against the external ear EE keeps the inserting body 10 and electroacoustic device 20, which is connected to the inserting body 10, stable, and prevents the inserting body 10 and electroacoustic device 20 from dropping off from the external ear EE.

The inserting body 10 is formed with an internal sound propagation path 11 and an external sound propagation path 13, and the active diaphragm 12 is provided inside the inserting body 10 for closing and opening the external sound propagation path 13. The internal sound propagation hole 11 extends along the centerline of the inserting body 10, and the external sound propagation path 13 is formed around the internal sound propagation hole 11. The internal sound propagation path 11 is open onto both end surfaces of the inserting body 10, and the external sound propagation path 13 is also open onto both end surfaces of the inserting body 10.

The inserting body 10 includes an outer bell-shaped wall 10*c* and an inner cylindrical wall 10*d*. The internal sound propagation path 11 is formed in the inner cylindrical wall 10*d*, and is open at both ends thereof to the outside through a sound inlet port 11*a* and a sound outlet port 11*b*.

One end portion of the outer bell-shaped wall 10*c* is merged with one end portion of the inner cylindrical wall 10*d*. However, the other end portion of outer bell-shaped wall 10*c* is spaced from the other end portion of inner cylindrical wall 10*d*. For this reason, a hollow space C takes place between the outer bell-shaped wall 10*c* and the inner cylindrical wall 10*d*. The hollow space C is defined by an inner surface 10*a* and an outer surface 10*b* of the outer bell-shaped wall 10*c*. Four sound outlet holes 13*a*, 13*b*, 13*c* and 13*d* are formed in the one end portion of outer bell-shaped wall 10*c*, and are arranged around the sound outlet port 11*b* of the internal sound propagation path 11 as will be better seen in FIG. 2A. A seat 10*e* takes place between the hollow space C and the sound outlet holes 13*a* to 13*d*. The hollow space and sound outlet holes 13*a*, 13*b*, 13*c* and 13*d* as a whole constitute the external sound propagation path 13. The external sound propagation path 13 has a ring-shaped sound inlet port, and the ring-shaped sound inlet port is labeled with 13*e*.

A circular groove 11*a* is formed in the inner cylindrical wall 10*d* of inserting body 10, and is open to the internal sound propagation path 11. The circular groove 11 is parallel to the sound inlet port 13*e*, and is close to the sound inlet port 13*e*. The electroacoustic device 20 is partially inserted into the internal sound propagation hole 11 through the sound inlet port 13*e*, and a flange 20*e* of the electroacoustic device 20 is received in the circular groove 11*a* so as to make the inserting body 10 and electroacoustic device 20 connected to each other. The internal sound is radiated from the electroacoustic device 20, and enters the internal sound propagation path 13 through the sound inlet port 13*e*. The internal sound is propagated to the sound outlet port 11*b* along the internal sound propagation path 11, and is radiated into the external auditory meatus EA of user through the sound outlet port 11*b*.

The active diaphragm 12 is provided inside the hollow space C, and a conductive polymer actuator is used as the active diaphragm 12. The active diaphragm 12 has four leaf portions 12*a*, 12*b*, 12*c* and 12*d* and a circular boss portion 12*e*. Each of the four leaf portions 12*a* to 12*d* is spaced at right angle from adjacent leaf portions 12*b*/12*d*, 12*a*/12*c*, 12*b*/12*d* or 12*c*/12*a*. The leaf portions 12*a* to 12*d* are gently curved, and the curvature is approximately equal to that of the inner surface 10*a* around the sound outlet holes 13*a* to 13*d*. A center hole 12*f* is formed in the circular boss portion 12*e*, and the inner cylindrical wall 10*d* passes through the center hole 12*f*. The tolerance between the center hole 12*f* and the inner cylindrical wall 10*d* is tight enough to keep the active diaphragm 12 unmoved. As a result, the active diaphragm 12 is maintained on the seat 10*e*. The width of four leaf portions 12*a* to 12*d* are greater than the diameter of four sound outlet holes 13*a* to 13*d*, and the active diaphragms 12 is positioned in such a manner that the four sound outlet holes 13*a*, 13*b*, 13*c* and 13*d* are respectively over-lapped with the four leaf portions 12*a*, 12*b*, 12*c* and 12*d*. As a result, the four sound outlet holes 13*a* to 13*d* can be opened and closed with the four leaf portions 12*a* to 12*d*.

Figure 3A:
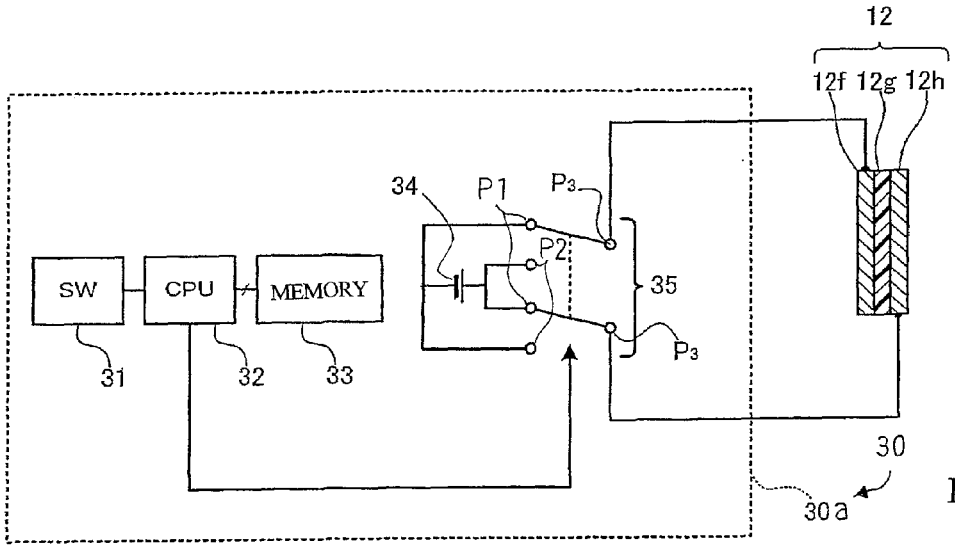
FIG. 3A is a circuit diagram showing the circuit configuration of an electronic system incorporated in a battery unit of the earphone device.

The active diaphragm 12 is formed from a sheet of electroactive polymer 12*g* and conductive plates 12*f* and 12*h* as will be seen in FIG. 3A. The conductive plates 12*f* and 12*h* serve as electrodes, and are formed of conductive metal such as, for example, gold, platinum, copper or aluminum, carbon or carbon-contained resin.

Conductive polymers and fluorine-contained ion exchange resins are available for the sheet of electroactive polymer 12*g*. The electroactive polymer is shrunk and expands on the condition of potential application. The shrinkage and expansion are dependent on the polarity of potential applied to the electroactive polymer. The electroactive polymers have been found in various applications such as, for example, actuators and artificial muscles.

While the applied potential is being in a predetermined polarity, the four leaf portions 12*a* to 12*d* are held in contact with the inner surface 10*a*, and the sound outlet holes 13*a* to 13*d* are closed with the leaf portions 12*a* to 12*d*, respectively. On the other hand, when the applied potential is changed to the opposite polarity, the leaf portions 12*a* to 12*d* are warped with respect to the circular boss portion 12*e*, and are spaced from the sound outlet holes 13*a* to 13*d*. As a result, the hollow space C is connected to the outside through the sound outlet holes 13*a* to 13*d*.

Turning back to FIG. 1, the battery unit 30 includes a battery case 30*a*, button switch 31, a battery cell unit 34 and a circuit board (not shown in FIG. 1). The circuit configuration on the circuit board will be hereinafter described with reference to FIG. 3A. The button switch 31 is exposed to the outside of the battery case 30*a* so that the user changes the polarity of applied potential by pushing the button switch 31. As described hereinbefore, the battery unit 30 is connected to the inserting body 10 and electroacoustic device 20 through a cable L2. The cable L2 is so flexible that the movements of battery unit 30 are absorbed by the cable L2. As a result, the movements of battery unit 30 is not transmitted to the inserting body 10, and the inserting body 10 is not unintentionally dropped off from the external ear EE of user due to the change of polarity.

The electroacoustic device 20 includes a diaphragm 20*a*, an exciter 20*b*, a housing 20*c* and a connector 20*d*. The housing 20*c* has a cylindrical configuration, and the diaphragm 20*a* and exciter 20*b* are accommodated in the housing 20*c*. The connector 20*d* also has a cylindrical configuration, and projects from the housing 20*c*. However, the cylindrical configuration of connector 20*d* is smaller in diameter than the cylindrical configuration of housing 20*c*. The housing 20*c* and connector 20*d* have a unitary structure. The connector 20*d* has the flange 20*e*, and the leading end portion of connector 20*d* is inserted into the internal sound propagation path 11. The flange 20*e* is received in the circular groove 11*a* so as to prevent the electroacoustic device 20 from separation between the inserting body 10 and the electroacoustic device 20. The length of connector 20*d* is greater than the distance between the sound inlet port 11*c* and the circular groove 11*a*. For this reason, the connector 20*d* keeps the electroacoustic device 20 spaced from the inserting body 10. In other words, the sound inlet port 13*e* is not closed with the electroacoustic device 20. For this reason, the external sound can enter the hollow space C at all times.

The exciter 20*b* is, by way of example, implemented by a coil unit, and the conduction path of cable L2 for the audio signal S1 is connected to the coil unit or exciter 20*b*. While the audio signal S1 is flowing through the exciter 20*b*, magnetic field is created around the exciter 20*b*, and the magnetic force is exerted on the diaphragm 20*a* in the magnetic field. The audio signal S1 causes the magnetic force to be varied so that the diaphragm 20*a* vibrates depending upon the magnitude of magnetic force. Thus, the audio signal S1 is converted to acoustic waves, i.e., the internal sound through the electroacoustic device 20. The acoustic waves or internal sound is radiated from the electroacoustic device 20 to the inserting body 10 without leakage into the outside of the electroacoustic device 20.

Turning to FIG. 3A of the drawings, an electronic system on the circuit board includes a central processing unit 32, a memory 33 and a DPDT (Double-Port Double-throw) switch 35. The central processing unit 32 and memory 33 may be implemented by a single-chip microcomputer device. The button switch 31 is connected to an input data pin of the central processing unit 32, and an output signal pin is connected to a control terminal of the DPDT switch 35. The central processing unit 32 is connected to a shared bus system to the memory 33. A computer program is stored in the memory 33, and data registers are further defined in the memory 33. The DPDT switch 35 has three pairs of nodes P1, P2 and P3. One of the notes P1 and one of the nodes P2 are connected to the positive terminal of the battery cell unit 34, and the others of the nodes P2 and P3 are connected to the negative terminal of the battery cell unit 34.

The DPDT switch 35 is responsive to a switch control signal at the control terminal so as selectively to connect the pair of nodes P1 or P2 to the pair of nodes P3. While the pair of nodes P1 is being connected to the pair of nodes P3 as shown in FIG. 3A, the battery unit 30 applies the potential in the predetermined polarity to the active diaphragm 12, and the potential makes the active diaphragm 12 expands. On the other hand, when the user wishes to hear the external sound, he or she makes the pair of nodes P2 connected to the pair of nodes P1. Then, the active diaphragm 12 is applied with the potential in the opposite polarity, and is shrunk. The active diaphragm 12 is warped, and the external sound is conducted through the external sound propagation path 13 to the external auditory meatus EA of user.

Figure 3B:
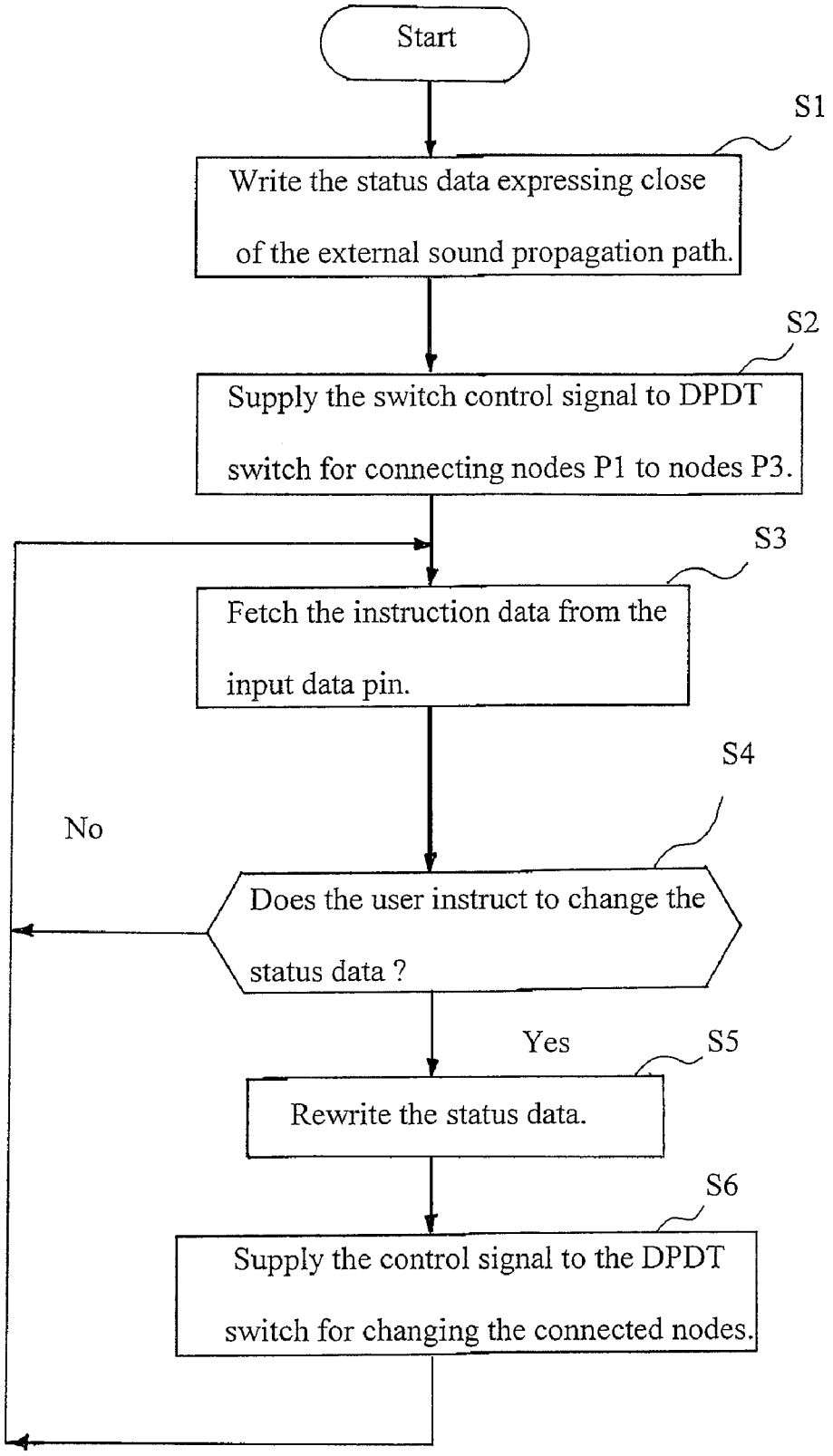
FIG. 3B is a flowchart showing a computer program running on a central processing unit of the electronic system.

Turning to FIG. 3B of the drawings, a job sequence of the computer program is illustrated. When the electronic system is powered, the computer program starts to run on the central processing unit 32. The central processing unit firstly carries out the system initialization, and, thereafter, reiterates a job loop until the electric power is removed from the central processing unit 32.

Figure 4A:
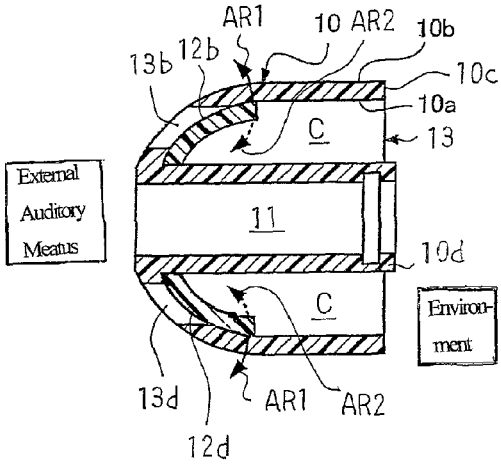
FIG. 4A is a cross sectional view showing the active diaphragm incorporated in the inserting body of the earphone device on the condition that the battery unit applies potential in a predetermined polarity.

In detail, the central processing unit writes a piece of status data expressing default status of the external sound propagation path 13 as by step S1. In this instance, the default status is closed state of the external sound propagation path 13. Thereafter, the central processing unit 32 supplies the switch control signal representative of the connection between the pair of nodes P1 and the pair of nodes P3 to the DPDT switch 35. The potential in the predetermined polarity is supplied from the battery unit 30 through the cable L2 to the active diaphragm 12, and makes the active diaphragm 12 expand as indicated by arrows AR1 in FIG. 4A. As a result, the sound outlet holes 13*a* to 13*d* are closed with the leaf portions 12*a* to 12*d* of active diaphragm 12, and the external auditory meatus EA of user is blocked from the environment. Upon completion of the job at step S2, the central processing unit 32 enters the job loop, and periodically monitors the input data pin connected to the button switch 31. Although the central processing unit 32 repeats the loop at time intervals slightly longer than the pulse width of a one-shot pulse signal supplied from the button switch 31, the jobs for measuring the time intervals are deleted from the job sequence for the sake of simplicity.

First, the central processing unit 32 fetches a piece of instruction data expressing user's instruction from the input data pin as by step S3. The user gives his or her instruction to the central processing unit 32 through the button switch 31. When the user once pushes the button switch 31, the one-shot pulse signal is generated, and is supplied from the button switch 31 to the input data pin of central processing unit 32. If the user pushes the button switch 31, again, the one-shot pulse signal is also supplied to the input data pin. Thus, the piece of instruction data, which expresses the change of piece of status data, is carried by the one-shot pulse signal. On the other hand, while the user is not wishing to change the state of external sound propagation path 13, he or she does not push the button switch 31, and any one-shot pulse signal is not supplied to the input data pin. In other words, the piece of instruction data, which expresses the unchanged of state of external sound propagation path 13, is expressed by the absence of one-shot pulse signal.

The central processing unit 32 checks the piece of instruction data to see whether or not the user wishes to change the state of external sound propagation path 13 as by step S4. If the user keeps the external sound propagation path 13 unchanged, the user does not push the button switch 31, and the piece of instruction data expresses the absence of one-shot pulse signal. Then, the answer at step S4 is given negative "No", and the central processing unit 32 returns to the step S3.

If, on the other hand, the user wishes to change the state of external sound propagation path 13, he or she pushes the button switch 31, and the piece of instruction data expresses the change of status data. For this reason, the answer at step S4 is given affirmative "Yes". The piece of status data stored in the data register is assumed to express the closed state of external sound propagation path 13. The central processing unit 32 rewrites the piece of status data expressing the closed state as by step S5 so that the piece of status data expresses the open state of external sound propagation path 13.

Figure 4B:
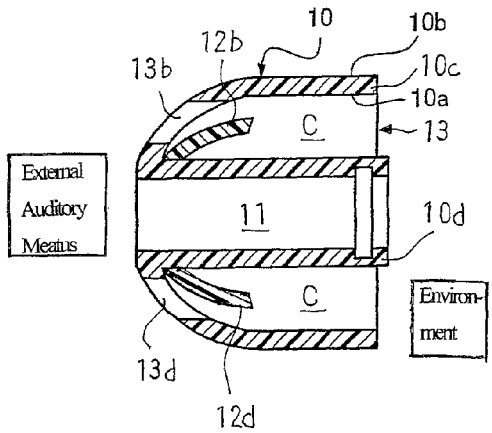
FIG. 4B is a cross sectional view showing the active diaphragm on the condition that the battery unit applies potential in the opposite polarity.

Subsequently, the central processing unit 32 supplies the switch control signal representative of the connection between the nodes P2 and the nodes P3 to the DPDT switch 35 as by step S6. With the switch control signal, the pair of nodes P1 is isolated from the pair of nodes P3, and the pair of nodes P2 is connected to the pair of nodes P3. The potential in the opposite polarity is applied to the active diaphragm 12. The electroactive polymer is shrunk, and the active diaphragm 12 is warped in the direction indicated by arrows AR2 in FIG. 4A. As a result, the leaf portions 12*a* to 12*d* are spaced from the inner surface 10*a* of the bell-shaped outer wall 10*c*, and the hollow space C is conducted to the external auditory meatus EA of user through the sound outlet holes 13*a* to 13*d* as shown in FIG. 4B. The external sound enters the external auditory meatus EA through the external sound propagation path 13, and the user can hear the external sound without taking off the inserting body 10.

As will be understood from the foregoing description, the active diaphragm 12 is moved with the potential through the electric coupling, i.e., the cable L2, and any rigid coupling is not required for the propagation of electric power PW. This results in that the inserting body 10 is free from the movements of the battery unit 30. For this reason, the inserting body 10 is not unintentionally dropped off from the external ear EE.

In this instance, the potential is applied to the active diaphragm 12 through the cable L2. Even though the force on the button switch 31 gives rise to movements of the battery case 30*a*, the force is not transmitted from the battery device 30 to the inserting body 10. For this reason, the inserting body 10 and electroacoustic device 20 are not unintentionally dropped off from the external ear EE of user.

Moreover, while the user is keeping the external sound propagation path 13 closed, the leaf portions 12*a* to 12*d* are pressed against the inner surface 10*a* of the bell-shaped wall 10*c*. The force makes the bell-shaped wall 10*c* of silicon resin outwardly expand. For this reason, the outer surface 10*b* of bell-shaped wall 10*c* are pressed to the skin defining the external auditory meatus EA. This feature is desirable, because the increase of friction between the outer surface 10*b* and the skin keeps the inserting body 10 stable in the external auditory meatus EA.

First Modification of Insert Earphone Device 100

Figure 5A:
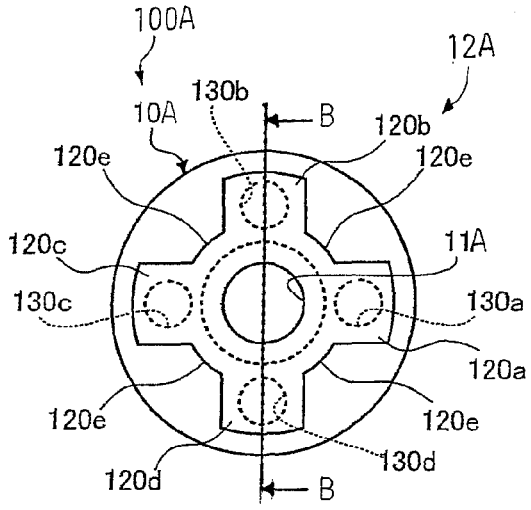
FIG. 5A is a left side view showing the arrangement of an inserting body of another insert earphone device of the present invention.
Figure 5B:
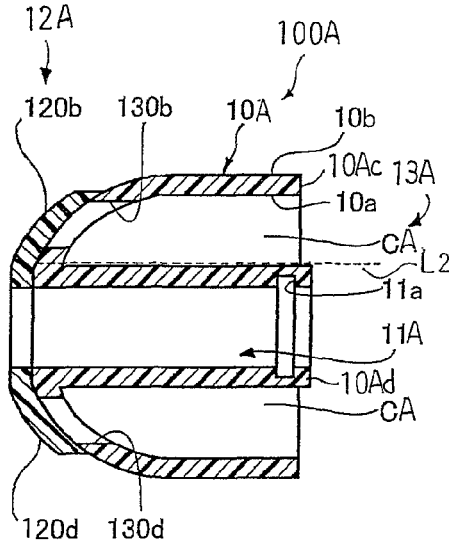
FIG. 5B is a cross sectional view taken along line B-B of FIG. 5A and showing the active diaphragm on the condition of application of potential in the predetermined polarity.
Figure 5C:
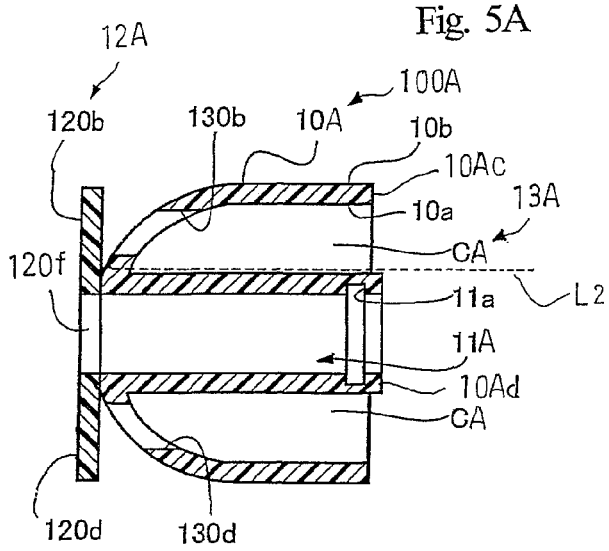
FIG. 5C is a cross sectional view showing the structure of the active diaphragm on the condition of application of potential in the opposite polarity.
Figure 6A:
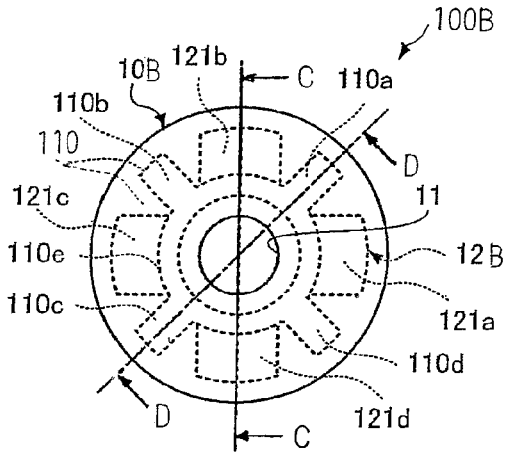
FIG. 6A is a left side view showing an active diaphragm provided inside an inserting body of yet another insert earphone device of the present invention.
Figure 6B:
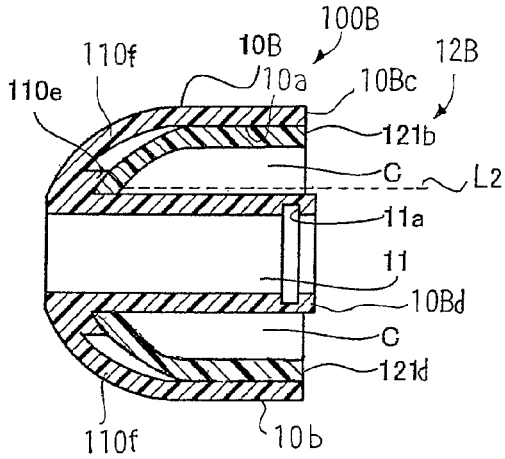
FIG. 6B is a cross sectional view taken along line C-C of FIG. 6A and showing a cross section of the active diaphragm.
Figure 6C:
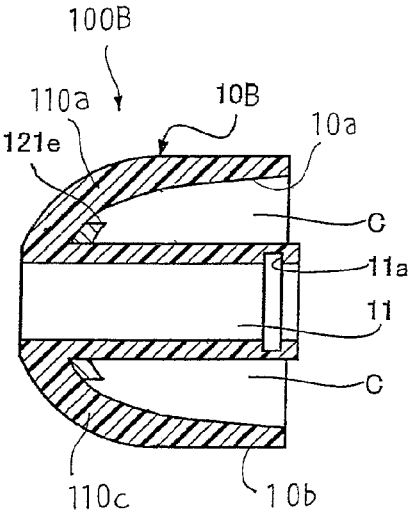
FIG. 6C is a cross sectional view taken along line D-D of FIG. 6A and showing another cross section of the active diaphragm.
Figure 6D:
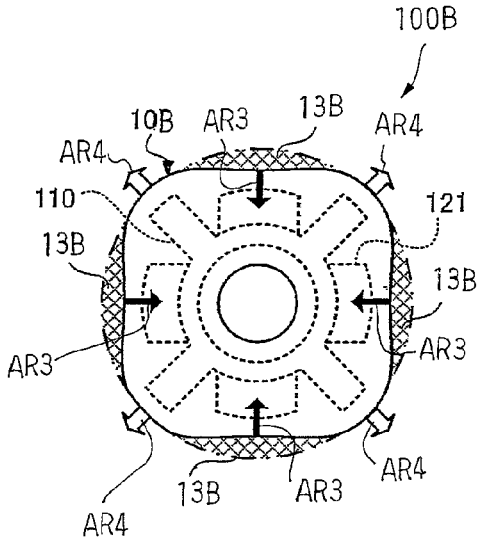
FIG. 6D is a left side view showing the inserting body deformed by the active diaphragm.

FIGS. 5A, 5B and 5C show an active diaphragm 12A of another insert earphone device 100A according to the present invention. Though not shown in the figures, the insert earphone device 100A further comprises an inserting body 10A, a battery unit and an electroacoustic device. The battery unit is connected to the active diaphragm 12A and electroacoustic device through a cable L2. The electroacoustic device and battery unit of insert earphone device 100A are similar to the electroacoustic device 20 and battery unit 30 so that no further description is incorporated for the sake of simplicity. A difference from the insert earphone device 100 is the active diaphragm 12A provided on the outer surface 10*b* of the inserting body 10A.

The inserting body 10A also has an outer bell-shaped wall 10Ac and an inner cylindrical wall 10Ad. The inner cylindrical wall 10Ad is connected at one end thereof to the outer bell-shaped wall 10Ac. However, the remaining portion of inner cylindrical wall 10Ad is spaced from the remaining portion of outer bell-shaped wall 10Ac. For this reason, hollow space CA takes place between the inner cylindrical wall 10Ad and the outer bell-shaped wall 10Ac as similar to that of the inserting body 10. An inner sound propagation path 11A is defined by the inner cylindrical wall 10Ad as similar to that 11 in the inner cylindrical wall 10*d*, and the circular groove 11*a* is formed in the inner cylindrical wall 10*d* for receiving the flange of connector incorporated in the electroacoustic device. The outer surface and inner surface of the outer bell-shaped wall 10Ac are also labeled with 10*b* and 10*a*.

Four sound outlet holes 130*a*, 130*b*, 130*c* and 130*d* are formed in the outer bell-shaped wall 10Ac, and are arranged around the inner sound propagation path 11. The sound outlet holes 130*a* to 130*d* are open to the hollow space CA and the outside of the inserting body 10A, and the hollow space CA and sound outlet holes 130*a* to 130*d* form in combination an external sound propagation path 13A.

The active diaphragm 12A is formed from an electroactive polymer layer and conductive layers. The electroactive polymer layer is sandwiched between the conductive layers, and the conductive layers serve as electrodes. The electrodes are connected to the DPDT switch of the battery unit through a flexible cable as similar to those of the insert earphone device 100.

Although the active diaphragm 12 is provided in the hollow space C, the active diaphragm 12A is provided on the outer surface 10*b* of outer bell-shaped wall 10Ac. The active diaphragm 12A has leaf portions 120*a*, 120*b*, 120*c* and 120*d* and a circular boss portion 120*e*. The leaf portions 120*a* to 120*d* outwardly project from the circular boss portion 120*e*, and are spaced at right angle from one another. A hole 120*f* is formed in the circular boss portion 120*e*, and is aligned with the sound outlet port of the internal sound propagation path 11A. The active diaphragm 12A is positioned in such a manner that the sound outlet holes 130*a* to 130*d* are respectively overlapped with the leaf portions 120*a* to 120*d*, and the circular boss portion 120*e* is secured to the outer surface 10*b* around the sound outlet port of internal sound propagation path 11A.

While potential is being applied to the active diaphragm 12A in the predetermined polarity, the active diaphragm 12A is warped, and the leaf portions 120*a* to 120*d* are held in contact with the outer surface 10*b* around the associated sound outlet holes 130*a* to 130*d* as shown in FIG. 5B. Although the external sound can enter the hollow space CA, the sound outlet holes 130*a* to 130*d* are closed with the leaf portions 120*a* to 120*d*, and the external auditory meatus EA is blocked from the external sound.

When the user wishes to hear the external sound, he or she changes the polarity of the potential as similar to that in the insert earphone device 100. Then, the active diaphragm 12A is straightened as shown in FIG. 5C, and the leaf portions 120*a* to 120*d* are spaced from the outer surface 10*b*. As a result, the hollow space CA is conducted to the external auditory meatus EA of user through the sound outlet holes 130*a* to 130*d*. The external sound enters the external auditory meatus EA through the sound outlet holes 130*a* to 130*d*, and gives rise to vibrations of the ear drum.

As will be understood, the active diaphragm 12A is warped and straightened depending upon the polarity of potential supplied from the battery unit (not shown). The potential is applied to the active diaphragm 12A through the electric coupling, i.e., the cable L2, and any rigid coupling is not required for the propagation of electric power. For this reason, the inserting body 10A and electroacoustic device (not shown) are not unintentionally dropped off from the external ear EE of user.

Moreover, while the internal sound is being radiated through the internal sound propagation path 11 into the external auditory meatus EA, the sound pressure is exerted on the active diaphragm 12A, and the leaf portions 120*a* to 120*d* are pressed to the outer surface of the outer bell-shaped wall 10A.

As a result, the sound outlet holes 130*a* to 130*d* are tightly closed with the leaf portions 120*a* to 120*d*. Thus, the sound pressure is available for the active diaphragm 12A. This results in reduction of the potential to make the active diaphragm 12A warped.

Second Modification of Insert Earphone Device 100

Turning to FIGS. 6A to 6D of the drawings, an inserting body 10B of yet another insert earphone device 100B is provided inside of an active diaphragm 12B. Although the insert earphone 100B further comprises an electroacoustic device (not shown) and a battery unit (not shown), the electroacoustic device and battery unit are similar to the electroacoustic device 20 and battery unit 30, and, for this reason, no further description is hereinafter incorporated for the sake of simplicity. In this instance, the battery unit (not shown) is electrically coupled with the electroacoustic device and active diaphragm 10B through a cable L2.

The inserting body 10B includes an outer bell-shaped wall 10Bc and an inner cylindrical wall 10Bd, and the outer bell-shaped wall 10Bc is connected at one end thereof to the inner cylindrical wall 10Bd as similar to those of the inserting body 10. Although an internal sound propagation path 11 is defined by the inner cylindrical wall 10Bd as similar to the inserting body 10, the outer bell-shaped wall 10Bc is not formed with any sound outlet hole. For this reason, the hollow space C can not be conducted to an external auditory meatus EA of a user. In this modification, an external sound propagation path 13B is formed between the outer surface of outer bell-shaped wall 10Bc and the skin defining the external auditory meatus EA as will be described hereinafter in detail.

The one end portion of outer bell-shaped wall 10Bc has a ring-shaped seat portion 110*e* around the inner cylindrical wall 10Bd, and the thickness of outer bell-shaped wall 10Bc is periodically increased and decreased around the ring-shaped seat portion 110*e*. As a result, thick portions 110*a*, 110*b*, 110*c* and 110*d* and thin portions 110*f* alternately take place in a flared portion 110 of the outer bell-shaped wall 10Bc. Each of the thick portions 110*a* to 110*d* is spaced from the adjacent thick portions 110*b*/110*d*, 110*a*/110*c*, 110*b*/110*d* or 110*c*/110*a* at right angle. The thin portions 110*f* are more deformable than the thick portions 110*a* to 110*d*.

The active diaphragm 12B is formed from an electroactive polymer layer and conductive layers, and the electroactive polymer layer is sandwiched between the conductive layers. The conductive layers serve as electrodes, and are connected to the cable L2.

The active diaphragm 12B has leaf portions 121*a*, 121*b*, 121*c* and 121*d* and a circular boss portion 121*e*. The circular boss portion 121*e* is held in contact with the seat portion 110*e*, and each of the leaf portions 121*a* to 121*d* is spaced from the adjacent leaf portions 121*b*/121*d*, 121*a*/121*c*/121*b*/121*d* or 121*c*/121*a* at right angle. The active diaphragm 12B is located in such a manner that the leaf portions 121*a* to 121*d* are offset from the thick portions 110*a* to 110*d*, respectively. The leaf portions 121*a* to 121*d* extend from the circular boss portion 110*e* over the thin portions 110*f*, and the leading end portions of leaf portions 121*a* to 121*d* are secured to the inner surfaces 10*a* of the outer bell-shaped wall 10Bc.

While the electroacoustic device (not shown) is converting the audio signal to the internal sound, the active diaphragm 12 is applied with the potential in the predetermined polarity, and the active diaphragm 12 keeps the outer bell-shaped wall 10Bc in the original configuration. The leaf portions 121*a* to 121*d* permit the outer surface 10*b* of outer bell-shaped wall 10Bc to be tightly held in contact with the skin of external ear EE which defines the external auditory meatus EA. The internal sound is propagated through the internal sound propagation path 11, and is radiated from the internal sound propagation path 11 to the external auditory meatus EA. However, the outer bell-shaped wall 10Bc, which is tightly held in contact with the skin of external ear EE, does not permit the external sound to enter the external auditory meatus EA.

The user is assumed to wish to hear the external sound. The user changes the potential to the opposite polarity, and the potential in the opposite polarity causes the leaf portions 121*a* to 121*d* to be sharply warped. The leaf portions 121*a* to 121*d* pull the outer bell-shaped wall 10Bc toward the inner cylindrical wall 10Bd. Although the thick portions 110*a* to 110*d* of flared portion 110 withstand the force, which is exerted on the outer bell-shaped wall 10Bc by the leaf portions 121*a* to 121*d*, the thin portions 110*f* of flared portion 110 are inwardly deformed as indicated by arrows AR3 in FIG. 6D, and gap takes place between the skin of external ear EE and the outer surface 10*b* of outer bell-shaped wall 10Bc. The gap is indicated by reticulated lines in FIG. 6D, and serves as the external sound propagation path 12B. The external sound is propagated through the external sound propagation path 13B, and is radiated from the external sound propagation path 13B to the external auditory meatus EA.

Since the thin portions 110*f* are inwardly deformed, the thick portions 110*a* to 110*d* outwardly swell as indicated by arrows AR4. This feature is desirable, because the outer surface 10*b* of thick portions 110*a* to 110*d* is pressed to the skin of external ear EE. Thus, the active diaphragm 12B not only forms the external sound propagation path 13B but also prevents the inserting body 10B from being dropped off from the external ear EE.

As will be understood, the active diaphragm 12B forms the external sound propagation path 13B between the skin of external ear EE and the outer surface 10*b* of outer bell-shaped wall 10Bc, and the electric coupling between the battery unit (not shown) and the active diaphragm 12B isolates the inserting body 10B from the force exerted on the button switch of the battery unit at the change of polarity. As a result, the user can hear the external sound without reinsertion of inserting body 10B into his or her external auditory meatus EA.

Second Embodiment

Figure 7:
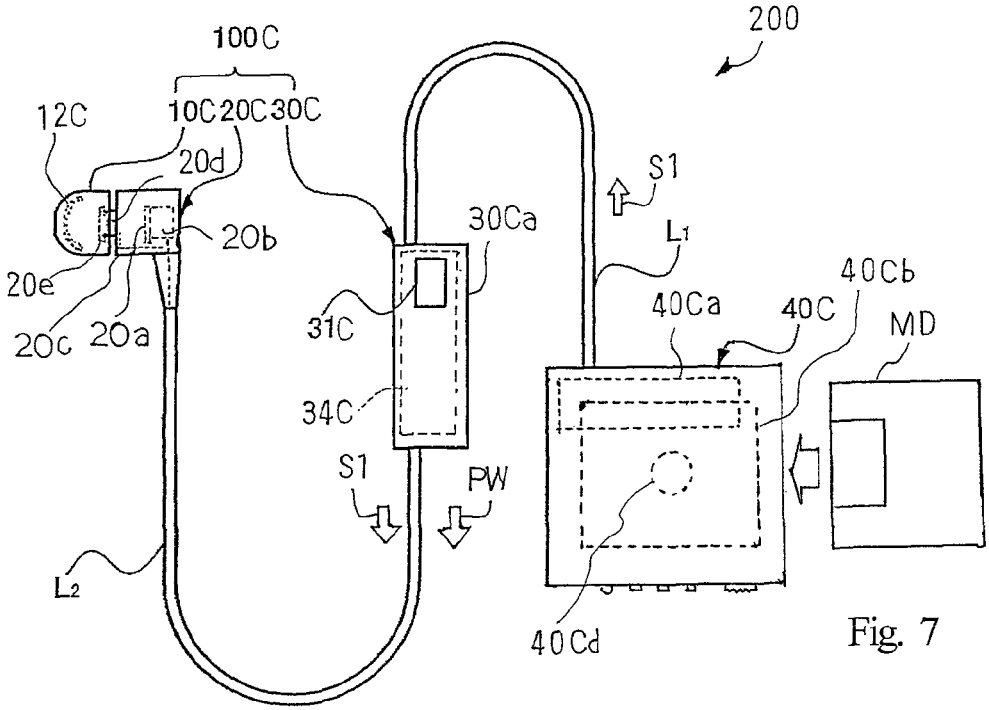
FIG. 7 is a front view showing the external appearance of a portable music player according to the present invention.

Referring to FIG. 7 of the drawings, a portable music player 200 largely comprises an audio signal reproducer 40C, a cable L1 and an insert earphone device 100C. The insert earphone device 100C is connected to the audio signal reproducer 40C through the cable L1, and plugs and sockets are used for the electric connections. A mini-disk MD is insertable into the audio signal reproducer 40C. Plural sets of digital music codes, which express music tunes, are stored in the mini-disk MD, and an analog audio signal S1 is reproduced from the digital music codes in the audio signal reproducer 40C. The audio signal S1 is supplied from the portable music to the insert earphone device 100C through the cable L1, and the audio signal S1 is converted to external music sound. The external music sound is radiated from the insert earphone device 100C into an external auditory meatus EA of a user, and gives rises to vibrations of the ear drum.

The audio signal reproducer 40C has a battery cell 40Ca, a circuit board 40Cb where an electronic system is mounted, and a spindle motor 40Cd. A laser diode, a photo diode and semiconductor integrated circuit devices are mounted on the circuit board, and form the electronic system. The semiconductor integrated circuit devices achieve a spindle servo control, a focus servo control, a tracking servo control and an error correction so as continuously to read out the digital music codes, and amplify and convert the digital music codes to the audio signal S1. The electronic system of portable music player behaves as similar to that of a standard MD player so that no further description is hereinafter incorporated for the same of simplicity. The audio signal S1 is supplied to the cable L1, and is propagated through the cable S1 to the insert earphone device 100C.

Figure 8A:
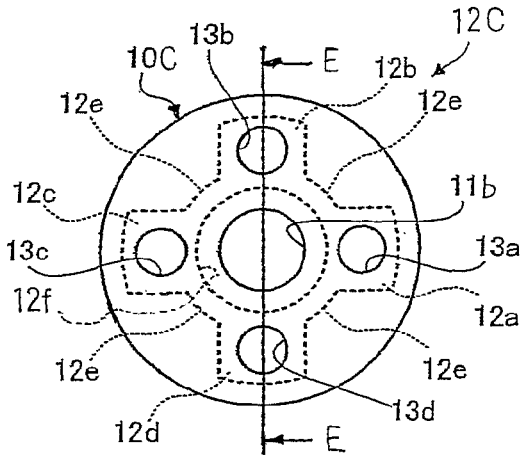
FIG. 8A is a left side view showing an active diaphragm provided in an inserting body of the insert earphone device incorporated in the portable music player.
Figure 8B:
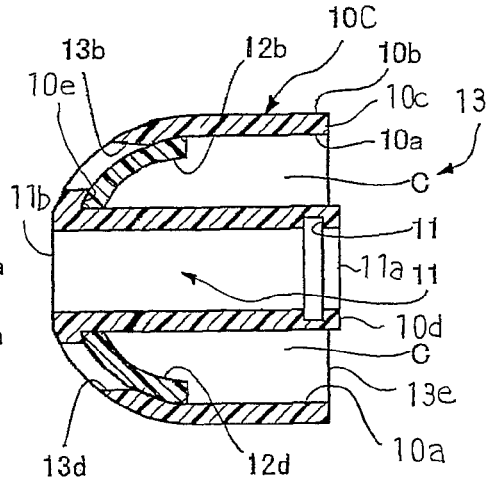
FIG. 8B is a cross sectional view taken along line E-E of FIG. 8A and showing the active diaphragm.
Figure 9:
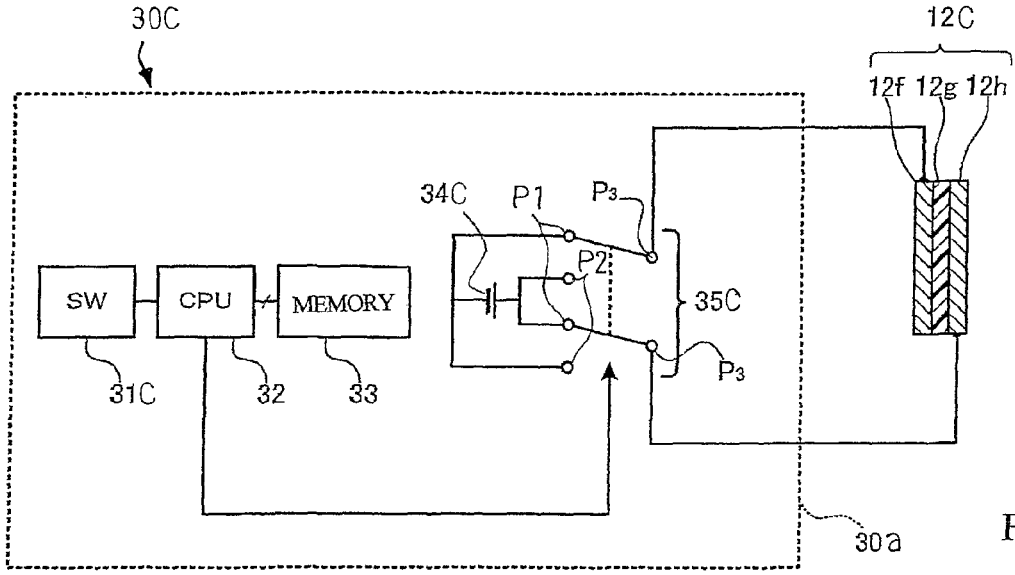
FIG. 9 is a circuit diagram showing the circuit configuration of an electronic system incorporated in a battery unit of the earphone device.

The insert earphone device 100C includes an inserting body 10C, an active diaphragm 12C, an electroacoustic device 20C and a battery unit 30C. As will be understood from FIGS. 8A and 8B, component parts of the inserting body 10C are similar in configuration and structure to those of the inserting body 10, and portions of the active diaphragm 12C are similar in structure and configuration to those of the active diaphragm 12. For this reason, the component parts of inserting body 10C and portions of active diaphragm 12C are labeled with references designating the corresponding component parts of inserting body 10 and the corresponding portions of active diaphragm 12, and description on the inserting body 10C and active diaphragm 12C is omitted for the sake of simplicity.

The battery unit 30C includes a button switch 31C, a housing 30Ca, a battery cell unit 34C, a DPDT switch 35C and a circuit board (not shown). The electronic system on the circuit board is identical in system configuration with the electronic system of the battery unit 30. For this reason, the system components are labeled with references designating the corresponding system components without detailed description for avoiding repetition.

Figure 10A:
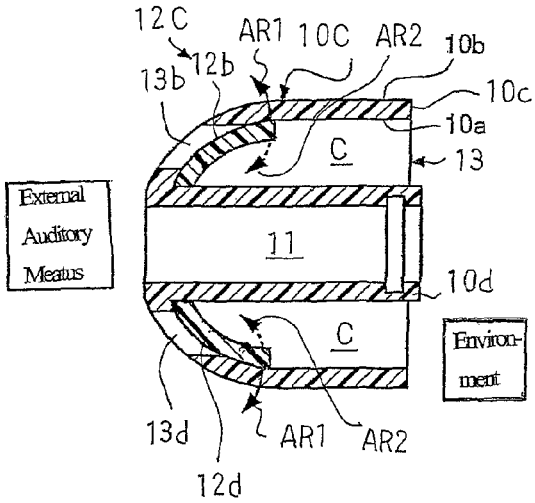
FIG. 10A is a cross sectional view showing the active diaphragm incorporated in the inserting body of the earphone device on the condition that the battery unit applies potential in a predetermined polarity.

A computer program runs on the central processing unit 32, and a job sequence of computer program is same as the job sequence illustrated in FIG. 3B. While the portable music player 200 is operating in playback mode, the sound outlet holes 13*a* to 13*d* are closed with the leaf portions 12*a* to 12*d* of active diaphragm 12C in the presence of potential in the predetermined polarity as shown in FIG. 10A, and the audio signal S1 is continuously converted to the internal music sound through the electroacoustic device 20C. Although the internal music sound is radiated from the internal sound propagation path 11 to the external auditory meatus EA of the user, the leaf portions 12*a* to 12*d* of active diaphragm 12 block the external auditory meatus EA from the external sound. For this reason, the user can listen to the music tune without noise.

Figure 10B:
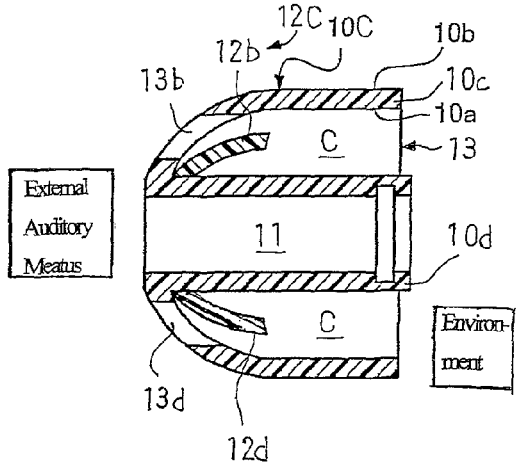
FIG. 10B is a cross sectional view showing the active diaphragm on the condition that the battery unit applies potential in the opposite polarity.

When someone talks to the user, he or she pushes the button switch 31C, and changes the potential to the opposite polarity. Then, the leaf portions 12*a* to 12*d* are warped, and are spaced from the sound outlet holes 13*a* to 13*d* as shown in FIG. 10B.

Modifications of Second Embodiment

Figure 11A:
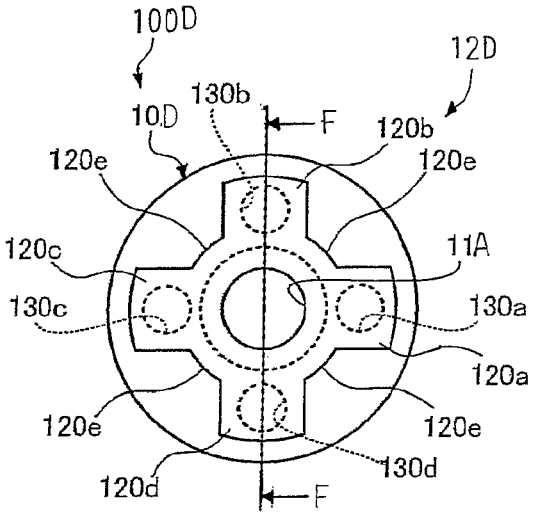
FIG. 11A is a left side view showing the arrangement of an inserting body of an insert earphone device incorporated in another portable music player of the present invention.
Figure 11B:
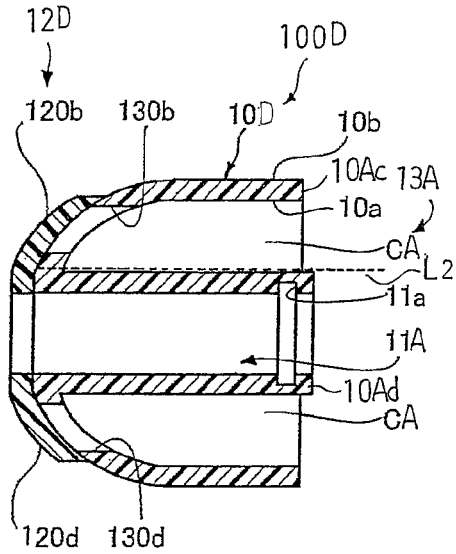
FIG. 11B is a cross sectional view taken along line F-F of FIG. 11A and showing the active diaphragm on the condition of application of potential in the predetermined polarity.
Figure 11C:
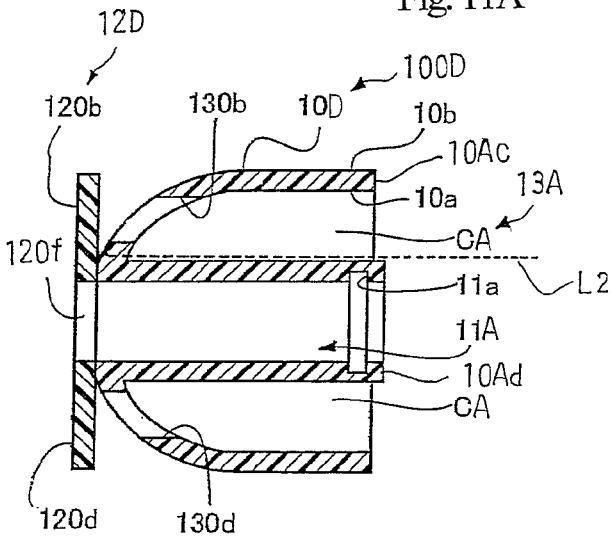
FIG. 11C is a cross sectional view showing the structure of the active diaphragm on the condition of application of potential in the opposite polarity.

FIGS. 11A, 11B and 11C show the first modification of the portable music player 200. The first modification is different from the portable music player 200 in that the insert earphone device 100C is replaced with an insert earphone device 100D. For this reason, an audio signal reproducer and a cable of the portable music player implementing the first modification are not illustrated in the drawings.

The insert earphone device 100D includes an insert body 10D, an electroacoustic device (not shown), an active diaphragm 12D and a battery unit (not shown) as similar to the insert earphone device 100C. The electroacoustic device and battery unit of insert earphone device 100D are similar to those of the insert earphone device 100C, and the insert body 10D and active diaphragm 12D are similar in structure to the insert body 10A and diaphragm 12A shown in FIG. 5A to 5C. For this reason, description on the electroacoustic device and battery unit is omitted, and component parts of the insert body 10D and component portions of the active diaphragm 12D are labeled with references designating the corresponding parts of insert body 10A and the corresponding portions of active diaphragm 12A without detailed description.

While a user is reproducing a music tune through the portable music player, the active diaphragm 12D is applied with the potential in the predetermined polarity so as to make the leaf portions 120*a* to 120*d* tightly held in contact with the outer surface 10*b* of outer bell-shaped wall 10D, and the internal music sound is being radiated from the internal sound propagation path 11 to the external auditory meatus EA of user. The user listens to the music tune. However, the leaf portions 120*a* to 120*d* do not permit the external sound to invade the external auditory meatus EA. For this reason, the user enjoys the music without any disturbance.

When another person talks to the user, he or she pushes the button switch so that the active diaphragm 12D is applied with the potential in the opposite polarity. The user may interpose the playback. The leaf portions 120*a* to 120*d* of active diaphragm 12 are warped, and are spaced from the inner surface 10*a* of outer bell-shaped wall 10Ac. The external sound propagation path 13A is conducted to the external auditory meatus EA of user, and permits the voice of another person to enter the external auditory meatus EA. Thus, the user can hear the voice without pulling out the insert body 10D. The battery case may be moved during the manipulation on the button switch. However, the cables L1 and L2 take up the movements of battery case. For this reason, the inserting body 10D does not drop off from the external ear EE.

FIGS. 12A to 12D show the second modification of the portable music player 200. The second modification is different from the portable music player 200 in that the insert earphone device 100C is replaced with an insert earphone device 100E. For this reason, an audio signal reproducer and a cable of the portable music player implementing the second modification are not illustrated in the drawings.

The insert earphone device 100E includes an insert body 10E, an electroacoustic device (not shown), an active diaphragm 12E and a battery unit (not shown) as similar to the insert earphone device 100C. The electroacoustic device and battery unit of insert earphone device 100E are similar to those of the insert earphone device 100C, and the insert body 10E and active diaphragm 12E are similar in structure to the insert body 10B and diaphragm 12B shown in FIG. 6A to 6D. For this reason, description on the electroacoustic device and battery unit is omitted, and component parts of the insert body 10E and component portions of the active diaphragm 12E are labeled with references designating the corresponding parts of insert body 10B and the corresponding portions of active diaphragm 12B without detailed description.

While a user is reproducing a music tune through the portable music player, the active diaphragm 12E is applied with the potential in the predetermined polarity so as to make the outer surface 10*b* of outer bell-shaped wall 10Bc tightly held in contact with the skin of external ear EE, and the internal music sound is being radiated from the internal sound propagation path 11 to the external auditory meatus EA of user. Although the user listens to the music tune, the outer bell-shaped wall 10Bc does not permit the external sound to invade the external auditory meatus EA. For this reason, the user enjoys the music.

Figure 12A:
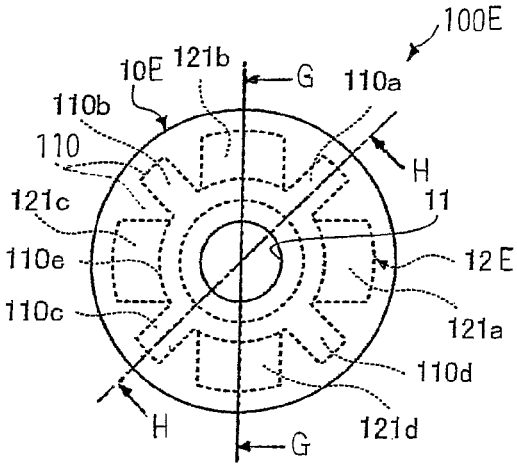
FIG. 12A is a left side view showing an active diaphragm provided inside an inserting body of an insert earphone device incorporated in yet another portable music player of the present invention.
Figure 12B:
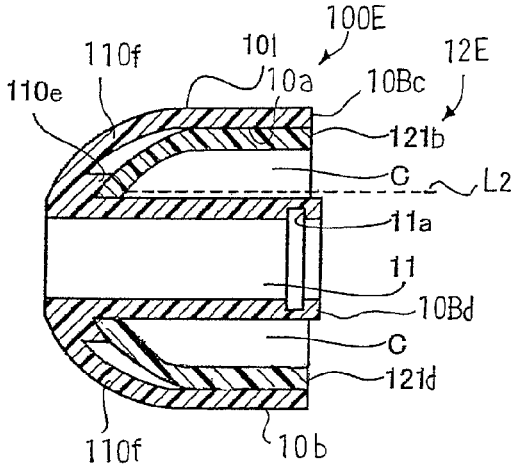
FIG. 12B is a cross sectional view taken along line G-G of FIG. 12A and showing a cross section of the active diaphragm.
Figure 12C:
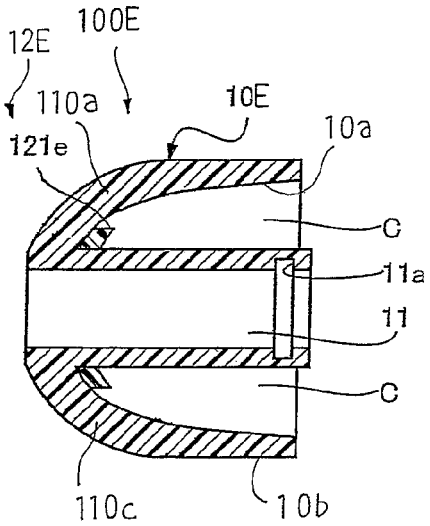
FIG. 12C is a cross sectional view taken along line H-H of FIG. 12A and showing another cross section of the active diaphragm.
Figure 12D:
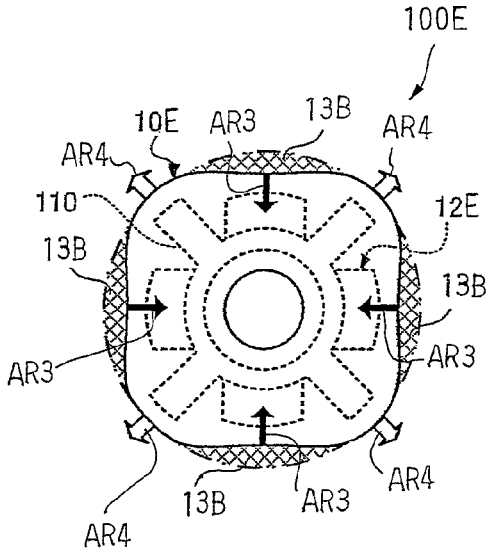
FIG. 12D is a left side view showing the inserting body deformed by the active diaphragm.

When another person talks to the user, he or she pushes the button switch so that the active diaphragm 12E is applied with the potential in the opposite polarity. The user may interpose the playback. The active diaphragm 12E inwardly pulls the outer bell-shaped wall 10Bc, and the gap takes place between the outer surface 10*b* of outer bell-shaped wall 10Bc and the skin of external ear EE as shown in FIG. 12D. The gap serves as the external sound propagation path 13B, and permits the voice of another person to enter the external auditory meatus EA. Thus, the user can hear the voice without pulling out the insert body 10E. The battery case may be moved during the manipulation on the button switch. However, the cables L1 and L2 take up the movements of battery case. For this reason, the inserting body 10E does not drop off from the external ear EE.

Figure 13A:
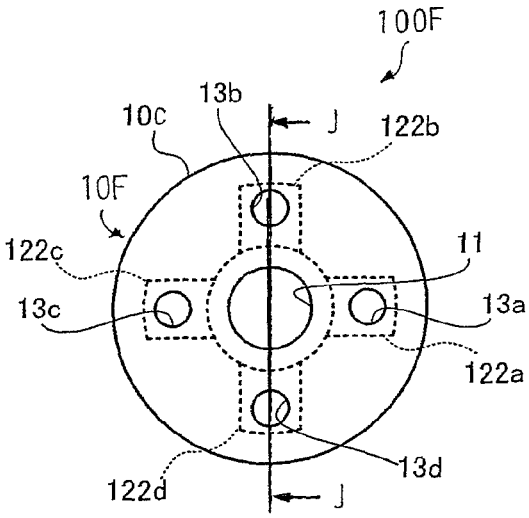
FIG. 13A is a left side view showing an active diaphragm provided inside an inserting body of an insert earphone device incorporated in still another portable music player of the present invention.
Figure 13B:
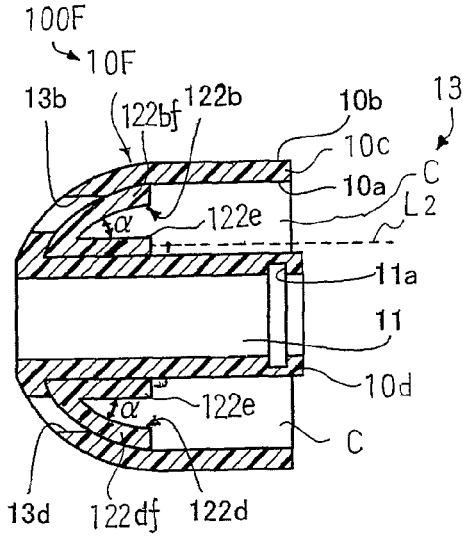
FIG. 13B is a cross sectional view taken along line J-J of FIG. 13A and showing a cross section of the active diaphragm.

Turning to FIGS. 13A and 13B of the drawings, an inserting body 10F forms a part of an insert earphone device 100F, which is incorporated in the third modification of the portable music player 200. The third modification is different from the portable music player 200 in that the insert earphone device 100C is replaced with an insert earphone device 100F. For this reason, an audio signal reproducer and a cable of the portable music player implementing the third modification are not illustrated in the drawings.

The insert earphone device 100F includes an insert body 10F, an electroacoustic device (not shown), active valve units 122*a*, 122*b*, 122*c* and 122*d* and a battery unit (not shown) as similar to the insert earphone device 100C. The electroacoustic device and battery unit of insert earphone device 100F are similar to those of the insert earphone device 100C, and the insert body 10E is similar in structure to the insert body 10C. For this reason, description on the electroacoustic device and battery unit is omitted, and component parts of the insert body 10F are labeled with references designating the corresponding parts of insert body 10C without detailed description.

The active valve units 122*a* to 122*d* are assigned to the sound outlet holes 13*a* to 13*d*, respectively, and each of the active valve units 122*a* to 122*d* is formed from conductive layers and an electroactive polymer layer sandwiched between the conductive layers. Each of the active valve units 122*a* to 122*d* has a boss portion 122*e* and a leaf valve 122*bf*/ 122*df* connected at one end thereof to the boss portion 122*e*. The angle between the boss portions 122*e* and associated leaf valves 122*bf* and 122*df* is labeled with alpha in FIG. 13B.

The boss portions 122*e* has an inner curved surfaces, and the inner curved surfaces have the radius of curvature equal to that of outer surface of inner cylindrical wall 10*d*. For this reason, the boss portions 122*e* are tightly secured to the inner cylindrical wall 10*d* at intervals, and each of the boss portions 122*e* is spaced from the adjacent boss portions 122*e*. Although the outer bell-shaped wall 10*c* is deformed during the insertion into the external auditory meatus EA, the inner cylindrical wall 10*d* keeps the cross section unchanged. For this reason, the boss portions 122*e* are not separated from the outer surface of inner cylindrical wall 10*d*. Moreover, the cable L2 is easily connected to the conductive layers of active valve units 122*a* to 122*d*, because the boss portions 122*e* are secured to the inner cylindrical wall 10*d*.

The leaf valves 122*bf* and 122*df* has outer curved surfaces, which have the radius of curvature equal to that of the inner surface 10*a*. However, the leaf valves 122*a* to 122*d* are not secured to the inner surface 10*a*. For this reason, when the active valve units 122*a* to 122*d* are applied with the potential in the predetermined polarity, the angle $\alpha$ is increased, and the outer surfaces of active valve units 122*a* to 122*d* are tightly brought into contact with the inner surface 10*a* around the sound outlet holes 13*a* to 13*d*. On the other hand, when the active valve units 122*a* to 122*d* are applied with the potential in the opposite polarity, the angle $\alpha$ is decreased, and the outer surfaces of leaf valves 122*a* to 122*d* are spaced from the inner surface 10*a*, and the hollow space C is conducted to the external auditory meatus EA through the sound outlet holes 13*a* to 13*d*.

While the active valve units 122*a* to 122*d* are being assembled with the inserting body 10F, the leaf valves 122*bf* and 122*df* are slightly pressed toward the boss portions 122*e*, and are inserted into the hollow space C. As a result, the leaf valves 122*a* to 122*d* outwardly expand in the hollow space C due to the resiliency of electroactive polymer, and the outer surfaces of leaf valves 122*a* to 122*d* are pressed to the inner surface 10*a* of outer bell-shaped wall 10*c*. For this reason, the potential in the predetermined polarity is reduced rather than the flat active diaphragm.

While a user is reproducing a music tune through the portable music player, the active valve units 122*a* to 122*d* are applied with the potential in the predetermined polarity so as to make the outer surfaces of leaf valves 122*bf* and 122*df* tightly held in contact with the inner surface 10*a* of outer bell-shaped wall 10*c*, and the internal music sound is being radiated from the internal sound propagation path 11 to the external auditory meatus EA of user. Although the user listens to the music tune, the active valve units 122*a* to 122*d* do not permit the external sound to invade the external auditory meatus EA. For this reason, the user enjoys the music.

When another person talks to the user, he or she pushes the button switch so that the active valve units 122*a* to 122*d* are applied with the potential in the opposite polarity. The user may interpose the playback. The active valve units 122*a* to 122*d* are inwardly warped, and the sound outlet holes 13*a* to 13*d* are opened to the hollow space C. The inserting body 10F permits the voice of another person to enter the external auditory meatus EA. Thus, the user can hear the voice without pulling out the insert body 10F. The battery case may be moved during the manipulation on the button switch. However, the cables L1 and L2 take up the movements of battery case. For this reason, the inserting body 10F does not drop off from the external ear EE.

Figure 14A:
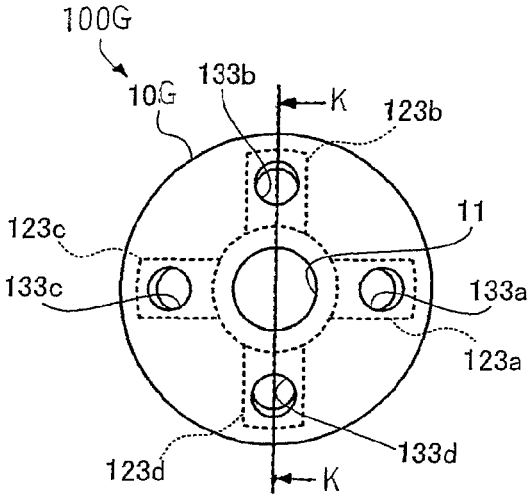
FIG. 14A is a left side view showing an active diaphragm provided inside an inserting body of an insert earphone device incorporated in yet another portable music player of the present invention.
Figure 14B:
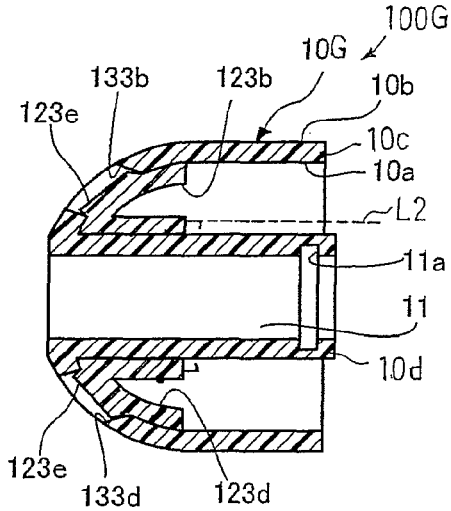
FIG. 14B is a cross sectional view taken along line K-K of FIG. 14A and showing a cross section of the active diaphragm.

Turning to FIGS. 14A and 14B of the drawings, an inserting body 10G forms a part of an insert earphone device 100G, which is incorporated in the fourth modification of the portable music player 200. The fourth modification is different from the portable music player 200 in that the insert earphone device 100C is replaced with an insert earphone device 100G. For this reason, an audio signal reproducer and a cable of the portable music player implementing the fourth modification are not illustrated in the drawings.

The insert earphone device 100G includes an insert body 10G, an electroacoustic device (not shown), active valve units 123*a*, 123*b*, 123*c* and 123*d* and a battery unit (not shown) as similar to the insert earphone device 100C. The electroacoustic device and battery unit of insert earphone device 100G are similar to those of the insert earphone device 100C. For this reason, description on the electroacoustic device and battery unit is omitted.

The inserting body 10G is similar to the inserting body 10F and, accordingly, inserting body 10C except for sound outlet holes 133*a*, 133*b*, 133*c* and 133*d*. Although the sound outlet holes 13*a* to 13*d* have respective centerlines extending in parallel to the centerline of the inner sound propagation path 11, the sound outlet holes 133*a* to 133*d* are outwardly directed so that the centerlines of sound outlet holes 133*a* to 133*d* cross the centerline of internal sound propagation path 11.

The active valve units 123*a* to 123*d* are similar to the active valve units 122*a* to 122*d* except for circular land portions 123*e*. The circular land portions 123*e* slightly project from the outer surfaces of the leaf valves of active valve units 123*a* to 123*d*. The circular land portions 123*e* have a generally column configuration, and the cross section of column configuration is slightly smaller in area than the cross section of sound outlet holes 133*a* to 133*d*. Moreover, the centerline of circular land portions 123*e* is spaced from the axes of rotation for the leaf valves equally to the distance between the axes of rotation and the centerlines of sound outlet holes 133*a* to 133*d*. For this reason, while the leaf valves of active valve units 133*a* to 133*d* are being pressed to the inner surface 10*a* of outer bell-shaped wall 10*c*, the circular land portions 123*e* penetrate into the associated sound outlet holes 133*a* to 133*d*.

The insert earphone device 100G achieves all the advantages of second embodiment. Moreover, the circular land portions 123*e* do not permit the external sound to be leaked into the external auditory meatus EA.

Figure 15A:
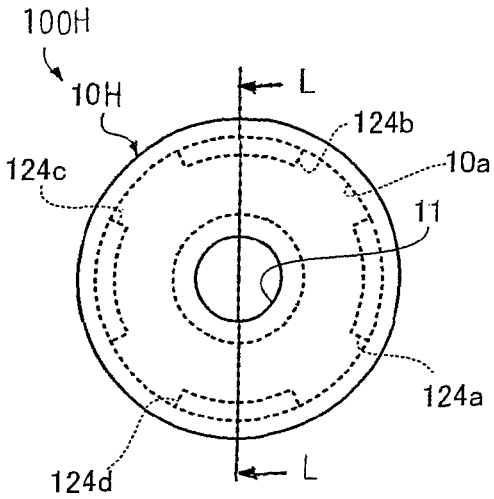
FIG. 15A is a left side view showing an active diaphragm provided inside an inserting body of an insert earphone device incorporated in still another portable music player of the present invention.
Figure 15B:
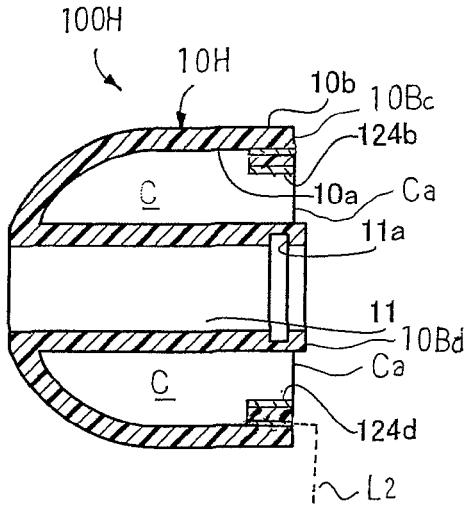
FIG. 15B is a cross sectional view taken along line L-L of FIG. 15A and showing a cross section of the active diaphragm.
Figure 15C:
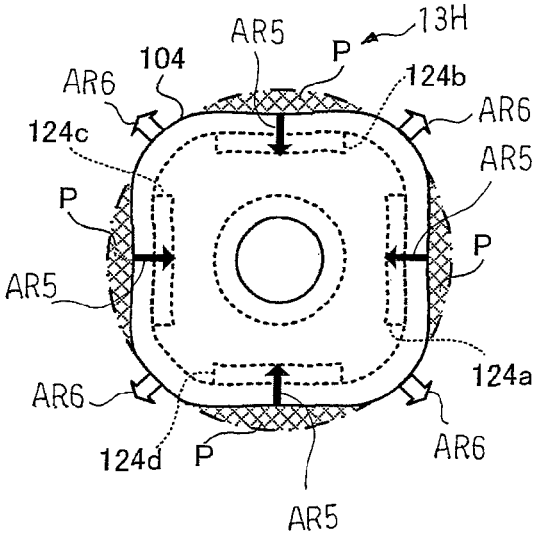
FIG. 15C is a left side view showing the inserting body deformed by the active diaphragm.

FIGS. 15A, 15B and 15C show an inserting body 10H and an active diaphragm 12H of an insert earphone device 100H incorporated in the fifth modification of portable music player 200. The fifth modification is different from the portable music player 200 in that the insert earphone device 100C is replaced with an insert earphone device 100H. For this reason, an audio signal reproducer and a cable of the portable music player implementing the fifth modification are not illustrated in the drawings.

The insert earphone device 100H includes an insert body 10H, an electroacoustic device (not shown), active bars 124*a*, 124*b*, 124*c* and 124*d* and a battery unit (not shown) as similar to the insert earphone device 100C. The electroacoustic device and battery unit of insert earphone device 100H are similar to those of the insert earphone device 100C, and the insert body 10H is similar in structure to the insert body 10B shown in FIG. 6A to 6D. For this reason, description on the electroacoustic device and battery unit is omitted, and component parts of the insert body 10H are labeled with references designating the corresponding parts of insert body 10B without detailed description. The opening of hollow space C is labeled with Ca in FIG. 15B.

The active bars 124*a* to 124*d* are provided in proximity of the opening Ca, and are adhered to the inner surface 10*a* of outer bell-shaped wall 10Bc. Each of the active bars 124*a* to 124*d* is spaced from the adjacent active bars 124*b*/124*d*, 124*c*/124*a*, 124*d*/124*b* or 124*a*/124*c* at right angle. The active bars 124*a* to 124*d* have electroactive polymer layers, respectively, and each of the electroactive layers is sandwiched between conductive layers. The conductive layers are connected to the cable L2.

The active bars 124*a* to 124*d* have a rectangular cross section, and are curved like an arc in the application of potential in the predetermined polarity. The arc has the radius of curvature equal to that of the inner surface 10*a* so that the active bars 124 to 124*d* keep the outer bell-shaped wall 10Bc in the original configuration as shown in FIG. 15A.

When the potential is changed to the opposite polarity, the active bars 124*a* to 124*d* increase the radius of curvature, and become substantially straight as shown in FIG. 15C. Then, force is locally exerted on the outer bell-shaped wall 10Bc in the inward direction as indicated by arrow AR5, and the outer bell-shaped wall 10Bc is deformed. The outer surface 10*b* of outer bell-shaped wall 10Bc is partially spaced from the skin of external ear EE, and clearance P takes place between the outer surface 10*b* and the skin of external ear EE. The clearance P serves as an external sound propagation path 13H.

The deformed portions of outer bell-shaped wall 10Bc cause the other portions to swell out as indicated by arrow AR6, and the other portions makes the outer surface 10*b* thereof pressed to the skin of external ear EE. As a result, the friction between the other portions and the skin is increased, and the increased friction keeps the inserting body 10H surely stable in the external auditory meatus EA.

As will be appreciated from the foregoing description, the active diaphragms 12, 12A, 12B, 12C, 12D and 12E, active valve units 122*a* to 122*d* and 123*a* to 123*d* and active bars 124*a* to 124*d* are electrically coupled with the source of electric power, and any rigid coupling is not required for the active diaphragms 12, 12A, 12B, 12C, 12D and 12E, active valve units 122*a* to 122*d* and 123*a* to 123*d* and active bars 124*a* to 124*d*. Even if the users control the electric power supply through their manipulation on the battery units 30 and 30C, any physical force is not exerted on the inserting bodies 10, 10A, 10B, 10C, 10D, 10E, 10F, 10G and 10H by virtue of the electric coupling. For this reason, the inserting body 10, 10A, 10B, 10C, 10D, 10E, 10F, 10G and 10H are maintained in stable in the external auditory meatuses EA of users. In other words, the inserting body 10, 10A, 10B, 10C, 10D, 10E, 10F, 10G and 10H are not unintentionally dropped off from the external auditory meatuses EA.

Although particular embodiments of the present invention have been shown and described, it will be apparent to those skilled in the art that various changes and modifications may be made without departing from the spirit and scope of the present invention.

The active diaphragms 12, 12A and 12B may be formed of another sort of electroactive material such as, for example, ionic-metal composite.

The active diaphragms 12, 12A, 12B, 12C, 12D, 12E and active valve units 122*a* to 122*d* and 123*a* to 123*d* and active bars 124*a* to 124*d* may keep themselves in the original configurations in the absence of potential. In this instance, the active diaphragms 12, 12A, 12B, 12C, 12D, 12E and active valve units 122*a* to 122*d* and 123*a* to 123*d* and active bars 124*a* to 124*d* are deformed under the condition that potential is applied thereto.

The inserting bodies 10, 10A and 10B and the associated housings 20*c* of electroacoustic devices may be molded together in such a manner as to have a unitary structure. In this instance, the component parts are easily assembled into the earphone devices.

The single-chip microcomputer device may be replaced with a suitable logic circuit. For example, the button switch 31 may be connected to a suitable bi-stable circuit such as, for example, a flip-flop circuit, and the DPDT switch 35 may be changed depending upon the output or outputs of the flip-flop circuit.

The alternately changed thickness, i.e., the thick portions 121*a* to 121*d* and thin portions 121*f* may not be required for the gap between the skin of external ear EE and the outer surface 10*b* of outer bell-shaped wall 10Bc. An outer bell-shaped wall of another modification may be uniform in thickness. In case where the outer bell-shaped wall has uniform thickness, a countermeasure against drop-off may be provided in the outer bell-shaped wall. For example, active layers, which have an electroactive polymer sandwiched between electrodes, are further provided in the hollow space C in such a manner as to be offset from the leaf portions 121*a* to 121*d*, and make the active layers press the portions of outer bell-shaped wall to the skin of external ear EE. Otherwise, suitable leaf springs may be embedded in the outer bell-shaped wall so as make the embedded portions of outer bell-shaped wall pressed to the skin of external ear EE.

The active diaphragm may be controlled through a suitable feedback loop. A suitable sensor is added to the inserting body 10B for producing a detecting signal representative of the cross sectional area of gap or pressure exerted on the skin of external ear EE. The detecting signal is supplied to the central processing unit of electronic system provided inside the battery unit, and the central processing unit instructs a variable resister to regulate the magnitude of potential applied to the active diaphragm 12B.

The number of leaf portions 12*a* to 12*d*, 120*a* to 120*d* or 121*a* to 121*d* and the number of sound outlet holes 13*a* to 13*d* or 130*a* to 130*d* do not set any limit to the technical scope of the present invention. The number is increasable and decreasable.

The circular cross section of sound outlet holes 13*a* to 13*d* and 130*a* to 130*d* does not set any limit to the technical scope of the present invention. The cross section of sound outlet holes 13*a* to 13*d* and 130*a* to 130*d* may be elliptical or polygonal.

The insert earphones do not set any limit to the technical scope of the present invention. For example, the present invention is applicable to a headphone. The headphone of the present invention is formed with an external sound propagation path as well as an internal sound propagation path, and an active diaphragm is provided in connection with the external sound propagation path so as to close the external sound propagation path with the active diaphragm and open it to the external auditory meatus EA.

An inserting body per se may be formed from a soft polymer player, flexible conductive polymer layers covered with the soft polymer layer and an electroactive polymer layer sandwiched between the flexible conductive polymer layers. In this instance, the inserting body per se is deformed so as to form an external sound propagation path.

The boss portions 122*e* of active valve units 122*a* to 122*d* may be connected to one another by means of a suitable tie plates. The tie plates may be also used for the boss portion 133*e* of active valve units 133*a* to 133*d*.

The circular land portions 123*e* may be made of soft synthetic resin. In this instance, the circular lands are adhered to the outer surface of the leaf portions 123*a* to 123*d*. The circular lands of soft synthetic resin make the sound outlet holes 133*a* to 133*d* tightly closed with the leaf portions 123*a* to 123*d*.

Figure 16:
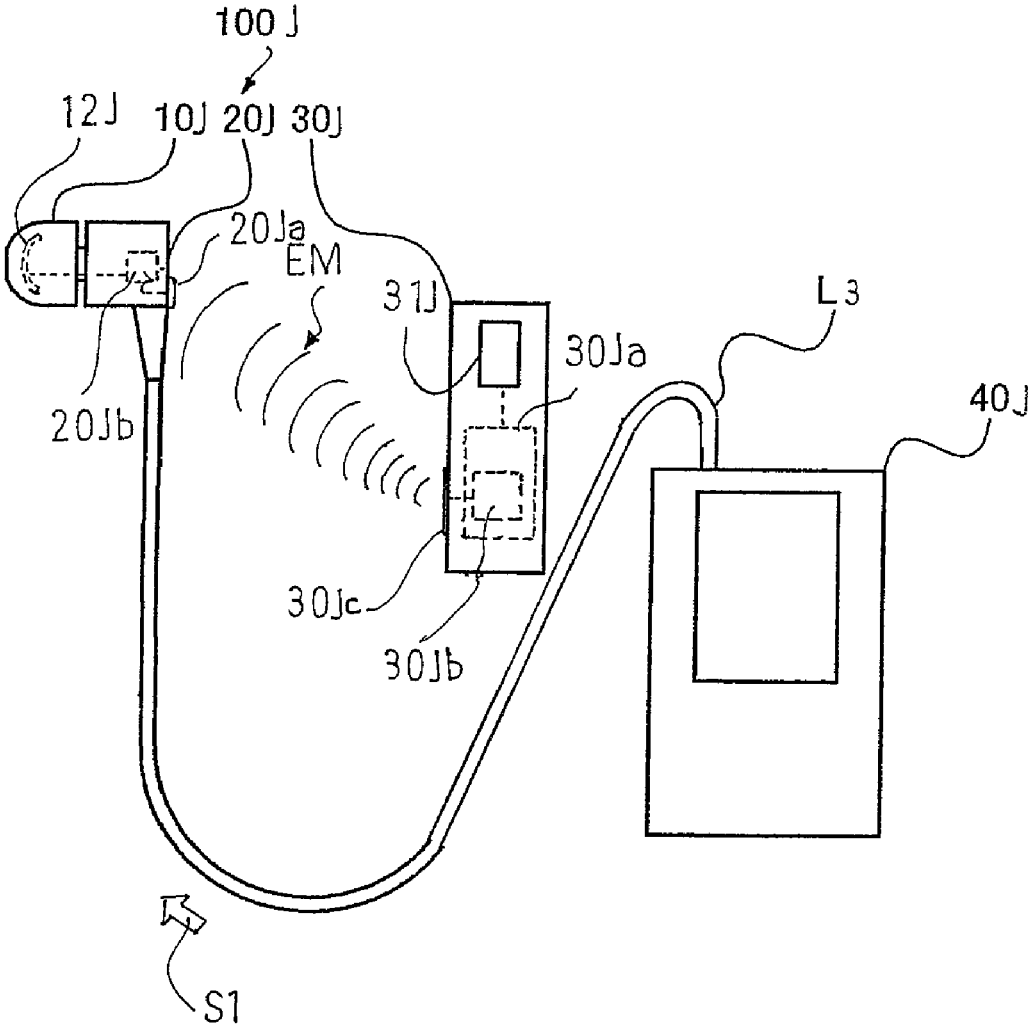
FIG. 16 is a front view showing a wireless coupling between a battery unit and an active diaphragm.

The cable L2 does not set any limit to the electric coupling. FIG. 16 shows an wireless coupling between a battery unit 30J and an active diaphragm 12J. A radio 40J, which serves as a sound signal generator, is directly connected to the electroacoustic device 20J through L3, and the audio signal S1 is directly supplied from the radio to the electroacoustic device 20J. The audio signal S1 is converted to the internal sound through the electroacoustic device 20*j*, and the internal sound is propagated to the external auditory meatus EA of user through the internal sound propagation path 11 in the inserting body 10J. The inserting body 10J is similar in structure and function to the inserting body 10, and the active diaphragm 12J is similar to the active diaphragm 12 except for the electroactive polymer layer. The electroactive polymer of active diaphragm 12J is deformed on the condition that potential is applied thereto, and returns to the original configuration when the potential is removed from the active diaphragm 12J The battery unit includes a battery cell unit, a button switch 31J and an electric circuit 30Ja. The electric circuit 30Ja has a transmitter 30Jb and an antenna 30Jc. While the user is hearing the internal sound, any radio frequency signal is not supplied from the transmitter 30Jb to the antenna 30Jc. When the user wishes to hear the external sound, he or she pushes the button switch 31J. Then, the radio frequency signal is supplied to the antenna 30Jc, and electromagnetic waves EM are radiated from the antenna 30Jc. An antenna 20Ja is provided on the housing of electroacoustic device 20J, and a receiver, rectifier and booster are incorporated in an electric circuit 20Jb together with the diaphragm and exciter. The electromagnetic waves EM is received at the antenna 2OJa, and is restored to the radio frequency signal through the receiver. The radio frequency signal is converted to direct current through the rectifier, and the direct current is boosted to a suitable potential level. The potential is supplied from the booster to the active diaphragm 12J so as to warp the leaf portions of active diaphragm. As a result, the hollow space in the inserting body 12J is conducted to the external auditory meatus EA through the sound outlet holes.

Figure 17A:
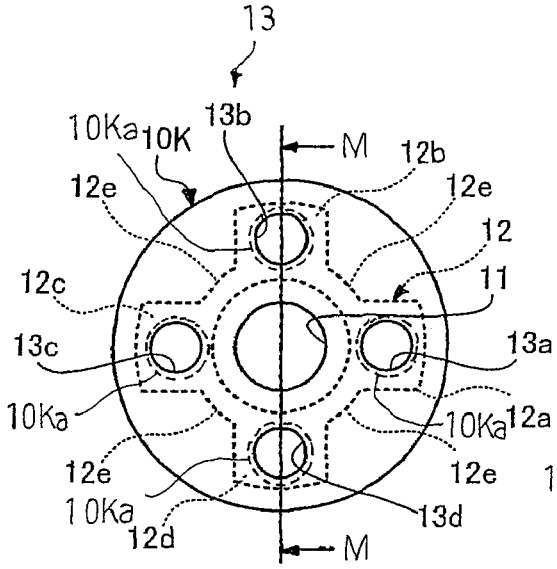
FIG. 17A is a left side view showing sealing ring portions formed on the inner surface around sound outlet holes.
Figure 17B:
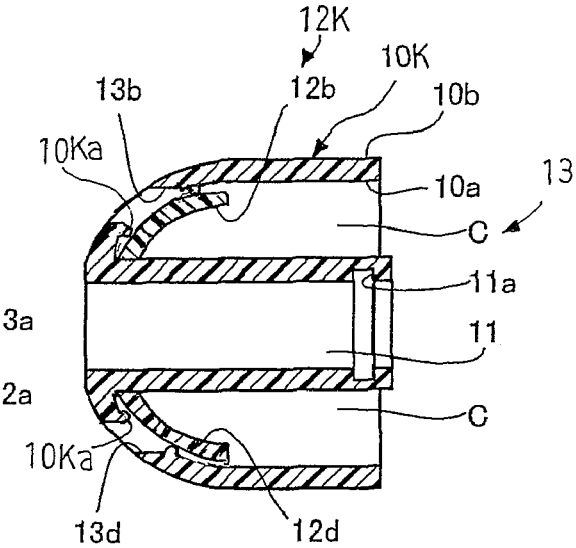
FIG. 17B is a cross sectional view taken along line M-M of FIG. 17A and showing the cross section of sealing ring portions.
Figure 18:
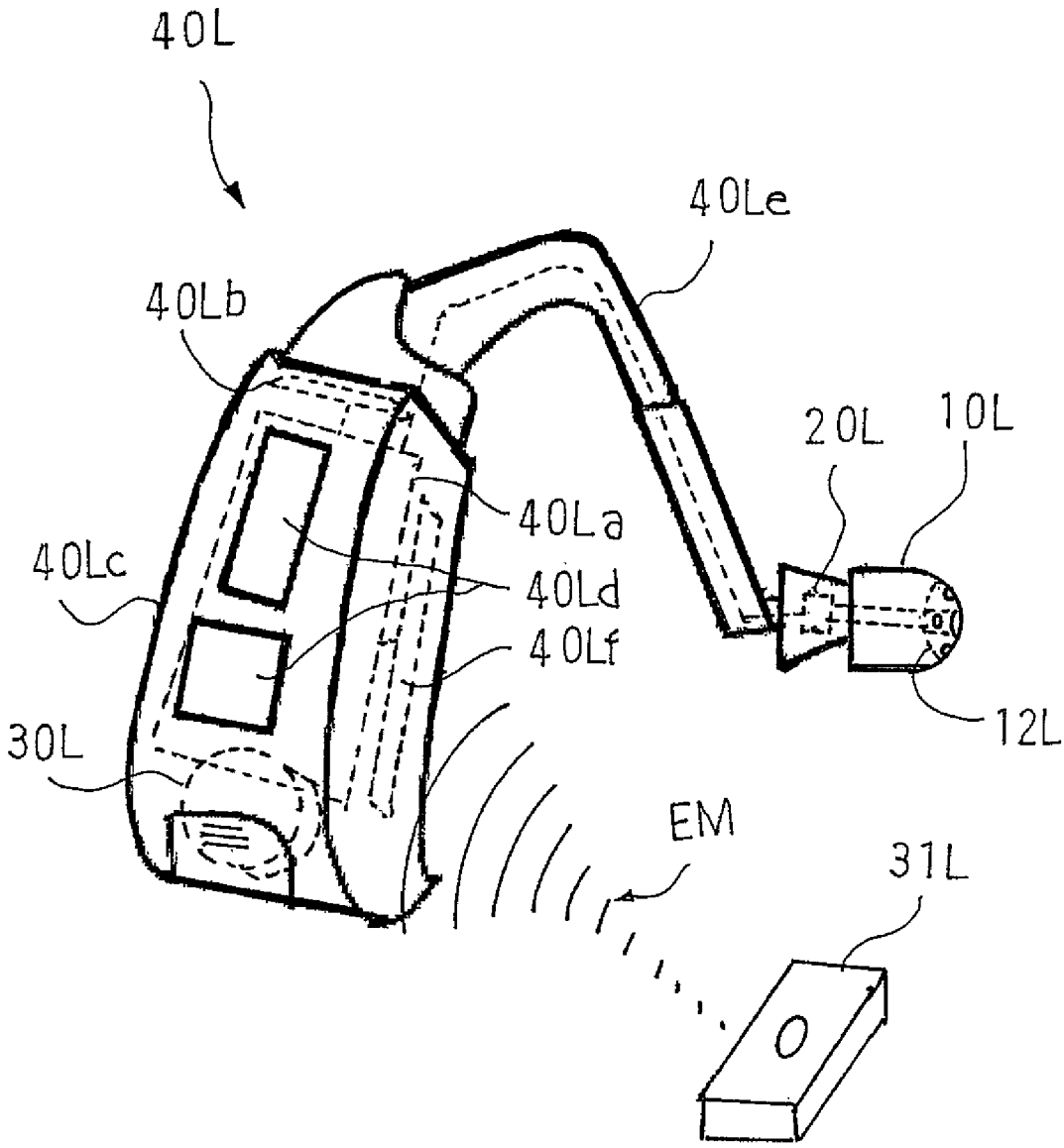
FIG. 18 is a perspective view showing an ear aid equipped with an active diaphragm of the present invention.

Sealing ring portions 10*ka* may be formed on the inner surface 10*a* around the sound outlet holes 13*a* to 13*d* as shown in FIG. 17A and 17B. The inserting body 10K shown in FIGS. 17A and 17B are similar in structure to the inserting body 10 except for the sealing ring portions 10Ka, and, for this reason, other portions are labeled with references designating the corresponding portions without detailed description. The sealing ring portions are formed around the sound outlet holes 13*a* to 13*d* so that the leaf portions 12*a* to 12*d* are bought into contact with the searing ring portions 10Ka instead of the inner surface 10*a* around the sound outlet holes 13*a* to 13*d*. A clearance is less liable to be formed between the searing ring portions 10Ka and the leaf portions 12*a* to 12*d*. For this reason, the leaf portions 12*a* to 12*d* perfectly block the external auditory meatus EA from the external sound.

Figure 19:
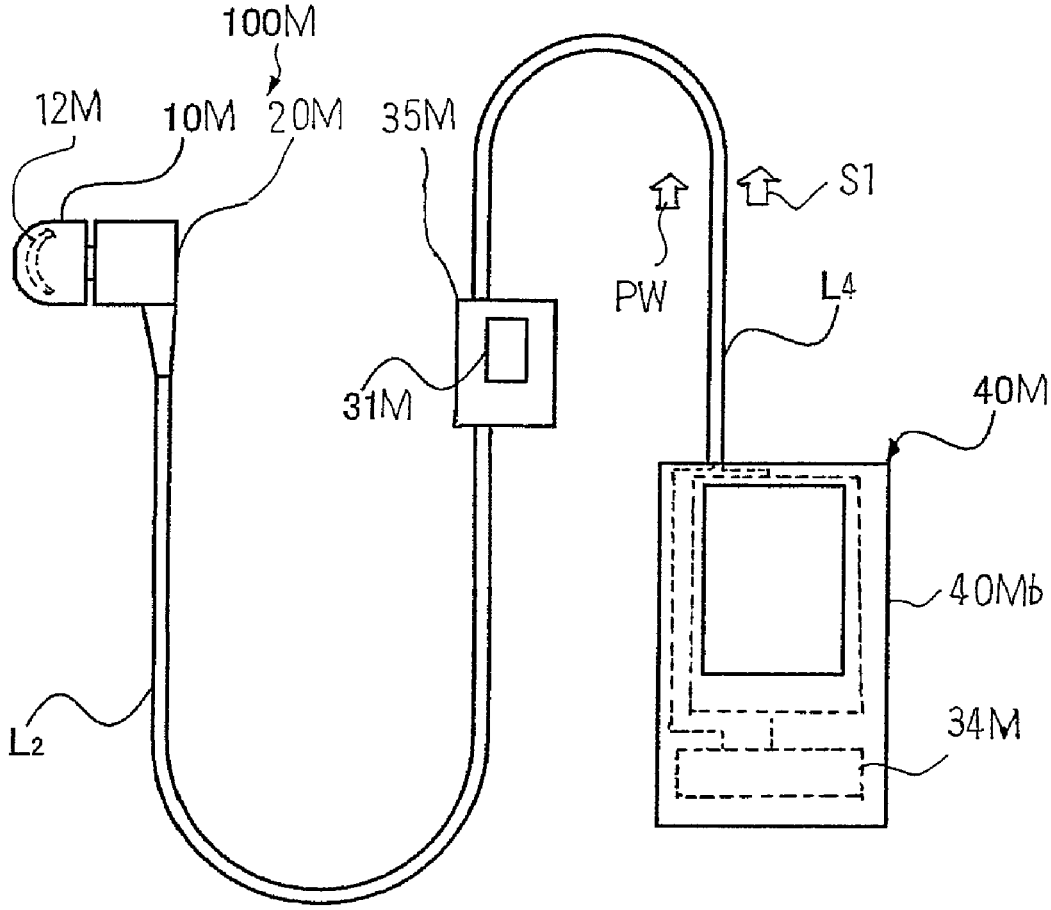
FIG. 19 is a front view showing an active diaphragm installed in an insert earphone device and applied with potential from a battery of a portable music player.

The portable music player 40C and radio 40J do not set any limit to the sound signal generator. FIG. 19 shows a hearing aid or an ear aid 40L. The ear aid 40L includes an electric circuit 40La, a microphone 40Lb, a housing 40Lc, switches 40Ld, an ear hook 40Le, an antenna 40Lf, a battery cell 30L, an electroacoustic device 20L, an inserting body 10L, an active diaphragm 12L and a change-over switch box 31L. The microphone 40Lb and antenna 40Lf are connected to the electric circuit 40La, which has circuitries required for controlling input voice and communication with the change-over switch box 31L, and the battery cell 30L supplies electric power to the electric circuit 40La. The electric circuit 40La, antenna 40Lf and battery cell 30L are provided inside the housing 40Lc, and the microphone 40Lb and switches 40Ld are exposed to the environment. The housing 40Lc is connected through the ear hook 40Le to the electroacoustic device 20L, which in turn is connected to the inserting body 10L. The active diaphragm 12L is provided inside the inserting body 10L, and the electroacoustic device 20 and active diaphragm 12L are connected to the electric circuit 40La. Users regulate the volume and tone quality to appropriate values by means of the switches 40Ld. The electric circuit 40La for the voice control and communication with the change-over switch box 31L are well known to persons skilled in the art, and the inserting body 10L and active diaphragm 12L are similar to the inserting body 10 and active diaphragm 12L. When a user requires the ear aid for conversation with a person, the user puts the ear hook 40Le behind the external ear EE, and inserts the inserting body 10L into the external auditory meatus EA. The voice is input through the microphone 40Lb to the electric circuit 40La, and the audio signal representative of the voice is supplied from the electric circuit 40La to the electroacoustic device 20L. The audio signal is converted to the internal sound through the electroacoustic device 20L, and the internal sound is radiated from the internal sound propagation path to the external auditory meatus EA of user. While the user is talking to the person, he or she may close the external sound propagation path with the active diaphragm 12L. In this situation, the potential in the predetermined polarity is supplied to the active diaphragm 12L. When the user wishes to hear environmental sound without any aid, he or she pushes the button switch of change-over control box 31L. Then, the electromagnetic waves EM are radiated from the change-over switch box 31L. The electromagnetic waves EM are received through the antenna 40Lf, and the electromagnetic waves are converted to a control signal. The control signal is supplied to the electric circuit 40La, and the potential in the opposite polarity is supplied to the active diaphragm 12L. The active diaphragm 12L is warped, and the environmental sound enters the external auditory meatus EA of user through the external sound propagation path.

The battery units 30 and 30C do not set a limit to the technical scope of the present invention. The sound signal generator 40M has a battery cell 34M in a case 40Mb thereof, and the battery cell 34M is shared between the sound signal generator 40M and an insert earphone device 100M. In this instance, the insert earphone device 100M includes an inserting body 10M, an active diaphragm 12M, an electroacoustic device 20M and a change-over switch box 35M. The sound signal generator 40M is connected to the change-over switch box 31 through a cable L4, and the electric power PW and audio signal S1 are supplied to the change-over switch box 35M through the cable L4. The ports of DPDT switch in the change-over switch box 31 may be directly changed by means of a switch 31M. The electroacoustic device 20M, inserting body 10M and active diaphragm 12M are identical with the electroacoustic device 20M, inserting body 10 and active diaphragm 12, and, for this reason, no further description is incorporated.

Figure 20:
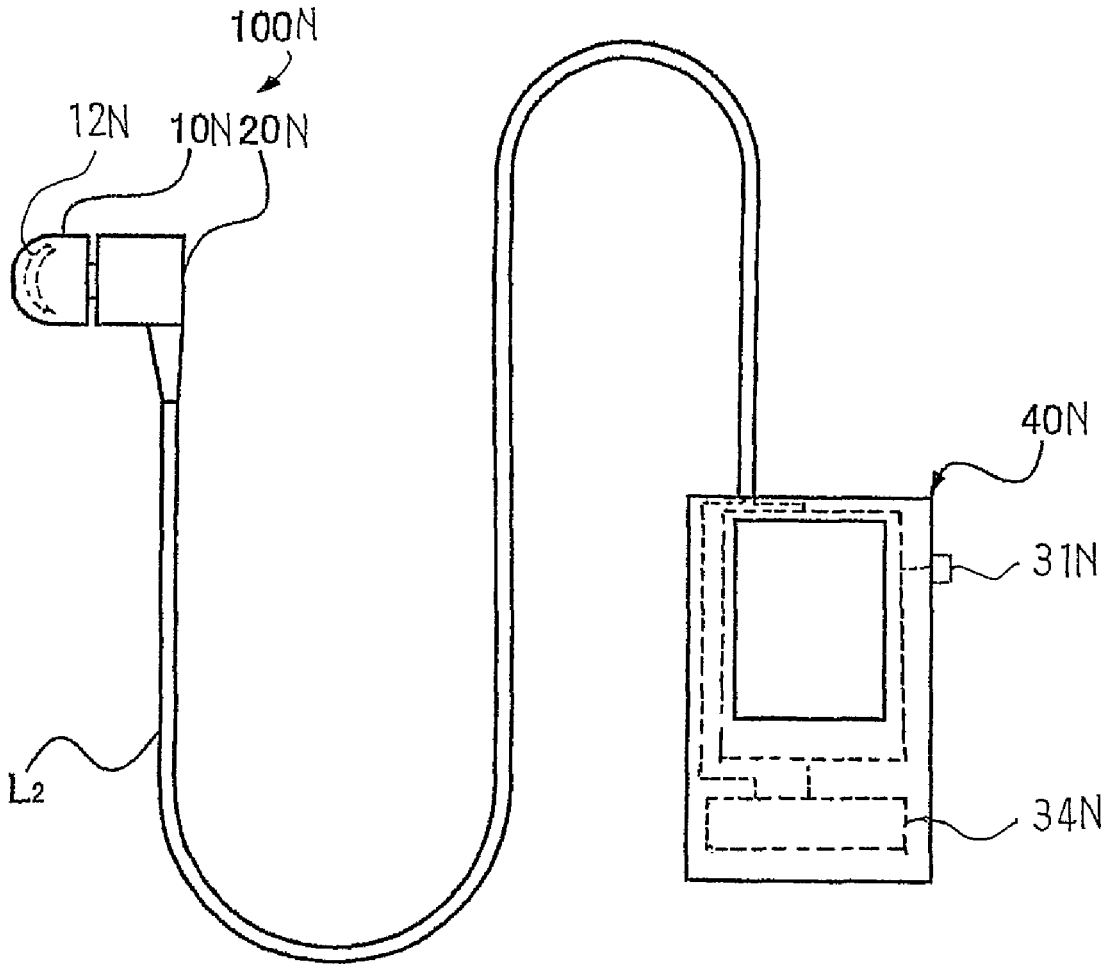
FIG. 20 is a front view showing an active diaphragm installed in an insert earphone controlled through an electronic circuit in a portable music player.

An inserting body 10N, an active diaphragm 12N and an electroacoustic device 20N may form an insert earphone device 100N of the present invention as shown in FIG. 20. In other words, the battery unit is not an indispensable element of the earphone device of the present invention. In this instance, both of the battery cell 34N and button switch 31*n* form parts of a sound signal generator 40N. The inserting body 10N, active diaphragm 12N and electroacoustic device 20N are identical with the inserting body 10, active diaphragm 12 and electroacoustic device 20.

Figure 21:
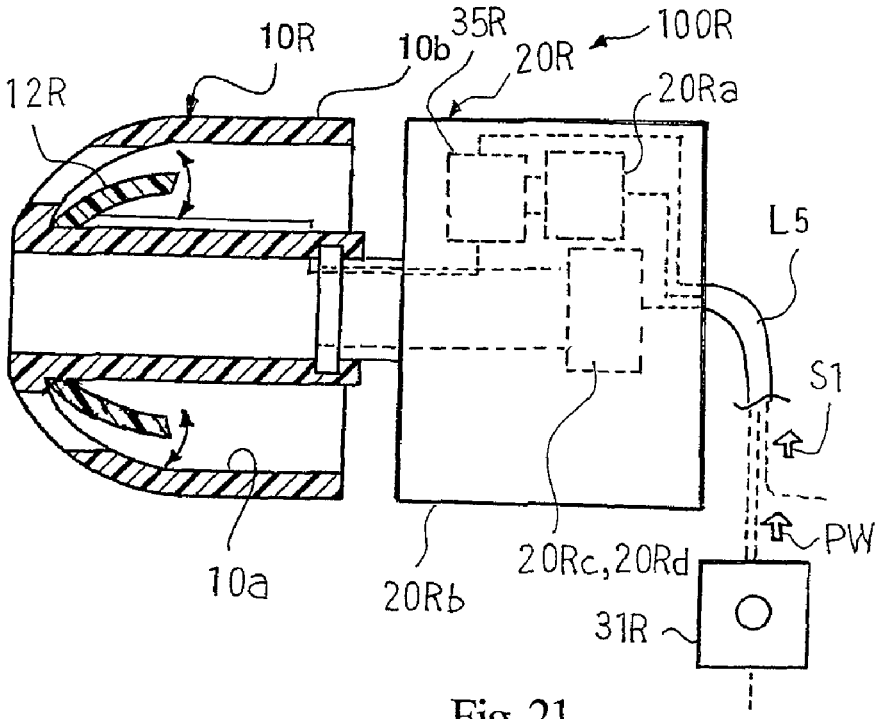
FIG. 21 is a cross sectional view showing an electric circuit for an active diaphragm incorporated in an electroacoustic device.

An electronic system 20Ra and a DPDT switch 35R may be housed in a case 20Rb of an electroacoustic device 20R together with a diaphragm and an exciter 20Rc/20Rd as shown in FIG. 21. An inserting body 10R, an active diaphragm 12R, case 20Rb, diaphragm and exciter 20Rc/20Rd are identical with the inserting body 10, active diaphragm 12 and those of the electroacoustic device 20, and the electronic system 20Ra and DPDT switch 35R are similar to those incorporated in the battery unit 30 except for an electric connection between a change-over switch box 31R and the central processing unit 32. The change-over switch box 31R is connected to the central processing unit through a cable L5, and the audio signal S1 and electric power PW are supplied from the switch box 31R also through the cable L5.

Figure 22:
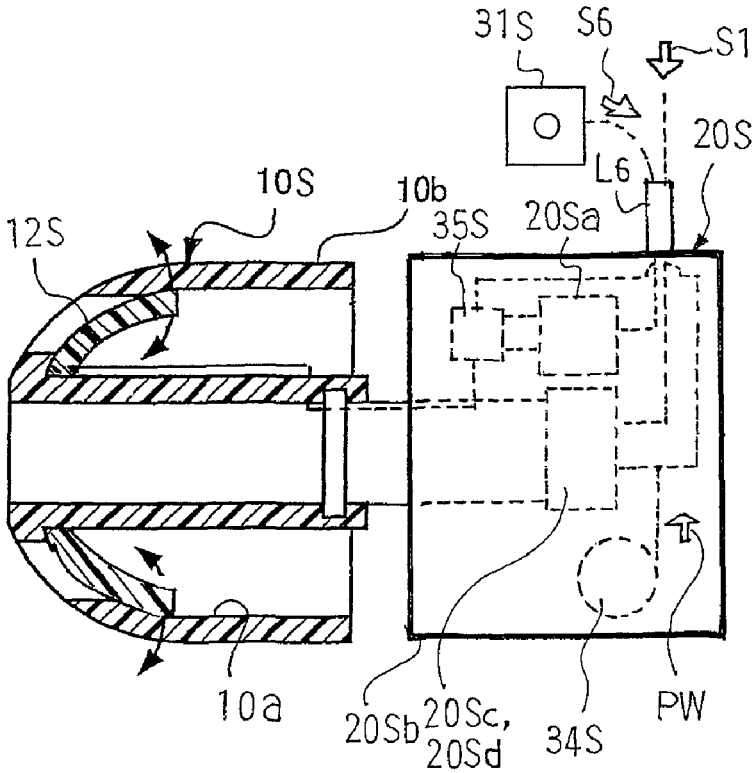
FIG. 22 is a cross sectional view showing an electric circuit and a battery cell incorporated in an electroacoustic device.

An electronic system 20Sa, a DPDT switch 35S and a battery cell 34S may be housed in a case 20Sb of an electroacoustic device 20S together with a diaphragm and an exciter 20Sc/20Sd as shown in FIG. 22. An inserting body 10S, an active diaphragm 12S, case 20Sb, diaphragm and exciter 20Sc/20Sd are identical with the inserting body 10, active diaphragm 12 and those of the electroacoustic device 20, and the electronic system 20Sa and DPDT switch 35S are similar to those incorporated in the battery unit 30 except for the battery cell 34S also housed in the case 20Sb. A change-over switch box 31S is connected to the electronic system 20Sa so that a switch control signal S6 is propagated from the change-over switch box 31S to the DPDT switch unit 35S through a cable L6. The audio signal S1 is supplied from a sound signal generator (not shown) also through the cable L6.

The outer bell-shaped wall and inner cylindrical wall may be produced separately. In this instance, the inner cylindrical wall is assembled with the outer bell-shaped wall after the separate production thereof. It is desirable to produce the outer bell-shaped wall of synthetic resin softer than that of the inner cylindrical wall, because the inserting body is well fitted to the skin defining the external auditory meatus.

The component parts of the above-described embodiments and modifications are correlated with claim languages as follows. An "earphone device" stands for not only the insert earphone devices but also other sorts of small-sized electric signal-to-sound converters of the type closing an external auditory meatus EA or meatuses EA. An example of the small-sized electric signal-to-sound converter is a headphone.

Each of the portable sound signal generator 40, audio signal reproducer 40C, radio 40J, ear aid 40L and sound signal generators 40M and 40N serves as "a source of sound signal". The audio signal S1 is corresponding to a "sound signal".

Each of the electroacoustic devices 20, 20C, 20J, 20L, 20M, 20N, 20R and 20S serves as a "signal-to-sound converter". Each of the inserting bodies 10, 10A, 10B, 10C, 10D, 10E, 10F, 10G, 10H, 10J, 10K, 10L, 10M, 10N, 10R and 10S is corresponding to a "retainer". Each of the internal sound propagation paths 11 and 11A is corresponding to an "internal sound propagation path", and each of the external sound propagation paths 13, 13A, 13B and 13H is corresponding to an "external propagation path". Each of the active diaphragms 12, 12A, 12B, 12C, 12D, 12E, 12J, 12K, 12L, 12M, 12N, 12R and 12S is corresponding to an "actuator". Each set of active valve units 122*a* to 122*d* and 123*a* to 123*d* also serve as the "actuator", and the set of active bars 124*a* to 124*d* also serve as the "actuator".

Each of the battery unit 34 and 34C and battery cells 30L, 34M, 34N and 34S serves as a "source of voltage". The button switch 31 or 31C, electronic system 32/33, DPDT switch 35 or 35C and cable L2 form in combination an "electric coupler". The button switch 31J, electronic circuit 30Ja, antenna 30Jc and 20Ja and receiver/rectifier/booster 20Jb also form in combination the "electric coupler". The change-over switch box 31L, antenna 40Lf, electric circuit 40La, power switch 40Ld and conductive path in the hook 40Le also form in combination the "electric coupler". The change-over switch box 35M and cables L2 and L4 form in combination the "electric coupler". The button switch 3 IN, electric circuit and cable L2 form in combination the "electric coupler". The change-over switch box 31R or 31S, electric circuit 20Ra or 20Sa and cable L5 or L6 form in combination the "electric coupler".

The button switch 31 or 31C, electronic system 32/33 and DPDT switch unit 35 or 35C form in combination a "change-over switch". The button switch 31J, electronic system 30Ja, antennas 30Jc and 20Ja and electric circuit 20Jb also form in combination the "change-over switch".

What is claimed is:

1. An earphone device connected to a source of sound signal for radiating sound into at least one external auditory meatus of a human being, comprising:

a signal-to-sound converter converting said sound signal to internal sound;

a retainer connected to said signal-to-sound converter, engaged with at least one external ear of said human being, and forming an internal sound propagation path for propagating said internal sound from said signal-to-sound converter to said at least one external auditory meatus and at least a part of an external sound propagation path open at one end thereof to an environment and at the other end to at least one said external auditory meatus for propagating external sound; and an actuator connected to said retainer, and responsive to voltage so as to be deformed for closing said external sound propagation path therewith and permitting said environment to be conducted to said external auditory meatus through said external sound propagation path.

2. The earphone device as set forth in claim 1, in which said external sound propagation path is partly defined by an inner surface of said retainer so as to be formed inside said retainer.

3. The earphone device as set forth in claim 2, in which said actuator is provided in said external sound propagation path so as to be spaced from said inner surface for making said external sound propagation path conducted to said at least one external auditory meatus and brought into contact with said inner surface for closing said external sound propagation path.

4. The earphone device as set forth in claim 2, in which said actuator is formed on an outer wall of said retainer around an sound outlet port of said external sound propagation path so as to be spaced from said outer surface for making said external sound propagation path conducted to said at least one external auditory meatus and brought into contact with said outer surface for closing said external sound propagation path.

5. The earphone device as set forth in claim 2, in which said external sound propagation path has at least one sound outlet hole, which has a center axis obliquely directed toward a skin of said human being defining said at least one external auditory meatus.

6. The earphone device as set forth in claim 2, in which said retainer has an inner cylindrical wall defining said inner sound propagation path and an outer bell-shaped wall having one end portion connected to one end portion of said inner cylindrical wall and the other end portion spaced from the other end portion of said inner cylindrical wall so that a hollow space takes place between an outer surface of said inner cylindrical wall and an inner surface of said outer bell-shaped wall.

7. The earphone device as set forth in claim 6, in which at least one through-hole is formed in said outer bell-shaped wall, wherein said through-hole and said hollow space form in combination said external sound propagation path.

8. The earphone device as set forth in claim 1, in which an outer surface of said retainer forms a part of said external sound propagation path, wherein a remaining part of said external sound propagation path is formed by a skin of said human being defining said at least one external auditory meatus.

9. The earphone device as set forth in claim 8, in which said actuator is provided inside said retainer, and gives rise to deformation of said retainer for creating a clearance between said outer surface and said skin under the application of said voltage.

10. The earphone device as set forth in claim 1, in which said actuator is formed from conductive layers applied with said voltage and a polymer layer sandwiched between said conductive layers and deformable with said voltage applied thereto through said conductive layers.

11. The earphone device as set forth in claim 1, further comprising a source of voltage connected to said actuator through an electric coupler.

12. The earphone device as set forth in claim 11, in which said electric coupler is a flexible cable.

13. A sound generating apparatus for generating internal sound to a human being, comprising:

a source of sound signal for producing a sound signal;

a source of voltage for generating voltage;

an earphone device including a signal-to-sound converter connected to said source of sound and converting said sound signal to said internal sound, a retainer connected to said signal-to-sound converter, engaged with at least one external ear of said human being and forming an internal sound propagation path for propagating said internal sound from said signal-to-sound converter to at least one external auditory meatus of said human being and an external sound propagation path open at one end thereof to an environment and at the other end thereof to said at least one external auditory meatus for propagating external sound, and an actuator connected to said retainer, and responsive to said voltage so as to be deformed for closing said external sound propagation path therewith and permitting said environment to be conducted to said external auditory meatus through said external sound propagation path; and an electric coupler provided between said source of voltage and said actuator so as to supply said voltage to said actuator.

14. The sound generating apparatus as set forth in claim 13, in which said source of voltage is physically separated from said source of sound signal and said earphone device, and includes a change-over switch for controlling said actuator through said voltage.

15. The sound generating apparatus as set forth in claim 14, in which the physically separated source of voltage is connected to said actuator through a flexible cable serving as said electric coupler.

16. The sound generating apparatus as set forth in claim 13, in which said source of sound signal is an electric device selected from the group consisting of a portable music player and a hearing aid.

17. The sound generating apparatus as set forth in claim 16, in which said source of voltage is provided inside said electric device so that said source of voltage is shared between said earphone device and said electric device.

18. The sound generating apparatus as set forth in claim 13, in which said source of voltage is provided in said signal-to-sound converter.

19. The sound generating apparatus as set forth in claim 13, in which said retainer has an inner cylindrical wall defining said inner sound propagation path and an outer bell-shaped wall having one end portion connected to one end portion of said inner cylindrical wall and the other end portion spaced from the other end portion of said inner cylindrical wall so that a hollow space takes place between an outer surface of said inner cylindrical wall and an inner surface of said outer bell-shaped wall.

20. An inserting body of an earphone device, comprising:

a retainer connectable to a signal-to-sound converter, engaged with at least one external ear of said human being, and forming:

an internal sound propagation path for propagating internal sound from said signal-to-sound converter to at least one external auditory meatus of a human being and an external sound propagation path at least partly defined by said retainer and open at one end thereof to an environment and at the other end thereof to said at least one external auditory meatus for propagating external sound; and an actuator connected to said retainer, and responsive to voltage applied thereto so as to be deformed for closing said external sound propagation path therewith and permitting said environment to be conducted to said external auditory meatus through said external sound propagation path.

an actuator connected to said retainer, and responsive to voltage so as to be deformed for closing said external sound propagation path therewith and permitting said environment to be conducted to said external auditory meatus through said external sound propagation path.

* * * * *